US008135143B2

(12) United States Patent
Ishibashi et al.

(10) Patent No.: US 8,135,143 B2
(45) Date of Patent: Mar. 13, 2012

(54) REMOTE CONFERENCE APPARATUS AND SOUND EMITTING/COLLECTING APPARATUS

(75) Inventors: Toshiaki Ishibashi, Fukuroi (JP); Satoshi Suzuki, Toyohashi (JP); Ryo Tanaka, Hamamatsu (JP); Satoshi Ukai, Hamamatsu (JP)

(73) Assignee: Yamaha Corporation (JP)

( * ) Notice: Subject to any disclaimer, the term of this patent is extended or adjusted under 35 U.S.C. 154(b) by 880 days.

(21) Appl. No.: 12/093,849

(22) PCT Filed: Nov. 10, 2006

(86) PCT No.: PCT/JP2006/322488

§ 371 (c)(1),
(2), (4) Date: May 15, 2008

(87) PCT Pub. No.: WO2007/058130

PCT Pub. Date: May 24, 2007

(65) Prior Publication Data

US 2009/0052688 A1 Feb. 26, 2009

(30) Foreign Application Priority Data

Nov. 15, 2005 (JP) ..... 2005-330730
Mar. 17, 2006 (JP) ..... 2006-074848

(51) Int. Cl.
*H04R 3/00* (2006.01)

(52) U.S. Cl. ..... 381/92; 381/91; 381/122; 381/59; 381/95; 381/96; 381/94.1; 381/94.2; 381/94.3; 381/94.4; 381/94.5; 381/94.6; 381/94.7; 381/94.8; 381/94.9; 379/202.01; 348/14.16; 348/E7.077; 348/E7.083

(58) Field of Classification Search ..... 381/92, 381/91, 122, 59, 94.1–94.9, 95, 96; 379/202.01; 348/14.16, E7.077, E7.083
See application file for complete search history.

(56) References Cited

U.S. PATENT DOCUMENTS 2,496,031 A * 1/1950 Anderson et al. ..... 367/126
(Continued)

FOREIGN PATENT DOCUMENTS

JP 2-114799 A 4/1990
(Continued)

OTHER PUBLICATIONS

International search report issued in corresponding application No. PCT/JP2006/322488, dated Feb. 20, 2007.
(Continued)

*Primary Examiner* — Hrayr A Sayadian
(74) *Attorney, Agent, or Firm* — Rossi, Kimms & McDowell LLP

(57) ABSTRACT

A speaker array and microphone arrays positioned on both sides of the speaker array are provided. A plurality of focal points each serving as a position of a talker are set in front of the microphone arrays respectively symmetrically with respect to a centerline of the speaker array, and a bundle of sound collecting beams is output toward the focal points. Difference values between sound collecting beams directed toward the focal points that are symmetrical with respect to the centerline are calculated to cancel sound components that detour from the speaker array to microphones. Then, it is estimated based on totals of squares of peak values of the difference values for a particular time period that the position of the talker is close to which one of the focal points, and the position of the talker is decided by comparing the totals of the squares of the peak values of the sound collecting beams directed to the focal points that are symmetrical mutually.

9 Claims, 12 Drawing Sheets

U.S. PATENT DOCUMENTS

| | | | | |
|---|---|---|---|---|
| 3,794,766 | A * | 2/1974 | Cox et al. | 381/66 |
| 4,334,740 | A * | 6/1982 | Wray | 352/11 |
| 5,581,620 | A * | 12/1996 | Brandstein et al. | 381/92 |
| 5,657,393 | A * | 8/1997 | Crow | 381/92 |
| 5,778,082 | A * | 7/1998 | Chu et al. | 381/92 |
| 6,069,961 | A * | 5/2000 | Nakazawa | 381/92 |
| 2001/0028720 | A1* | 10/2001 | Hou | 381/92 |
| 2001/0033649 | A1* | 10/2001 | Rogers | 379/388.01 |
| 2003/0059061 | A1 | 3/2003 | Tsuji et al. | |
| 2004/0001597 | A1* | 1/2004 | Marton | 381/71.1 |
| 2005/0008169 | A1* | 1/2005 | Muren et al. | 381/92 |
| 2005/0111674 | A1* | 5/2005 | Hsu | 381/92 |
| 2005/0141735 | A1* | 6/2005 | Kim | 381/313 |
| 2005/0207566 | A1 | 9/2005 | Ohki et al. | |
| 2005/0207591 | A1 | 9/2005 | Tsuji et al. | |
| 2006/0045289 | A1* | 3/2006 | Kujirai et al. | 381/92 |
| 2008/0181430 | A1* | 7/2008 | Zhang et al. | 381/92 |

FOREIGN PATENT DOCUMENTS

| | | | |
|---|---|---|---|
| JP | 03-136557 | A | 6/1991 |
| JP | 8-298696 | A | 11/1996 |
| JP | 9-261351 | A | 10/1997 |
| JP | 10-145763 | A | 5/1998 |
| JP | 10-215497 | A | 8/1998 |
| JP | 11-55784 | A | 2/1999 |
| JP | 2003-087890 | A | 3/2003 |
| JP | 2004-165775 | A | 6/2004 |
| JP | 2004-309536 | A | 11/2004 |
| JP | 2005-229433 | A | 8/2005 |
| JP | 2005-234246 | A | 9/2005 |

OTHER PUBLICATIONS

Notification of Reason for Refusal issued in corresponding Japanese Patent Application No. 2005-330730 dated Apr. 26, 2011.

Japanese Office Action, Notification of Reason for Refusal, in corresponding JP 2005-330730, dated Aug. 18, 2011. English translation provided.

* cited by examiner

REMOTE CONFERENCE APPARATUS AND SOUND EMITTING/COLLECTING APPARATUS

This application is a U. S. National Phase Application of PCT International Application PCT/JP2006/322488 filed on Nov. 10, 2006 which is based on and claims priority from JP 2005-330730 filed on Nov. 15, 2005, and JP 2006-074848 filed on Mar. 17, 2006 the contents of which is incorporated herein in its entirety by reference.

TECHNICAL FIELD

The present invention relates to equipment having microphone arrays and speaker arrays to reproduce a received sound and a sound field and, more particularly, the technology to specify a position of a talker or a sound source from the microphone array.

BACKGROUND ART

In the prior art, the means for receiving a sound on the transmitter side and reproducing a sound field of the sound on the transmitter side has been proposed (see Patent Literatures 1 to 3). In such equipment, sound signals picked up by a plurality of microphones, etc. are transmitted, and the sound field on the transmitter side is reproduced by using a plurality of speakers on the receiver side. Such equipment possesses the advantage that a position of a talker can be specified by the sound.

In Patent Literature 1, the method of creating stereophonic sound information by transmitting sound information received by a plurality of microphone arrays and then outputting the sound information from speaker arrays of the same number as the microphone arrays to reproduce the sound field of the sender side, etc. are disclosed.

According to the method of Patent Literature 1, certainly it is possible to transmit the sound field itself on the sender side and specify a position of the talker by the sound. However, there existed such a problem that a lot of line resources must be used. Hence, another means for specifying position information of the talker and transmitting the information, etc. are disclosed (see Patent Literature 2, for example).

In Patent Literature 2, such an equipment is disclosed that, on the transmitter side, a voice of a talker is picked up by the microphone, then talker position information is generated by talker information obtained by the microphone, and then the talker position information is multiplexed with the voice information and transmitted, while the receiver side changes a position of the speaker that is caused to sound based on the talker position information transmitted such that the voice and the position of the talker is reproduced on the receiver side.

In Patent Literature 3, such a session equipment is set forth that, because it is not practical to cause all talkers to grip the microphone respectively, phases of the sound signals being input into respective microphones are shifted and synthesized by using a microphone controlling portion to specify the talker. In Patent Literature 3, the phase pattern to give the maximum sound is decided by changing the phase shift pattern corresponding a seat position of the talker, and then a position of the talker is specified based on the decided phase shift pattern.

In the talk session equipment (the sound emitting/collecting apparatus) in Patent Literature 4, the sound signal input via the network is emitted from speakers arranged on the top surface, and sound signals picked up by respective microphones which are arranged on the side surface and whose front faces are set in plural different directions respectively are transmitted to the outside via the network.

Also, in the home announce equipment (the sound emitting/collecting apparatus) in Patent Literature 5, the talker direction is detected by applying a delay process to sound collecting signals from respective microphones of the microphone array respectively, and a volume of sounds emitted from the speakers adjacent to this talker is reduced.

Patent Literature 1: JP-A-2-114799
Patent Literature 2: JP-A-9-261351
Patent Literature 3: JP-A-10-145763
Patent Literature 4: JP-A-8-298696
Patent Literature 5: JP-A-11-55784

DISCLOSURE OF THE INVENTION

Problems that the Invention is to Solve

However, in above Patent Literatures, following problems existed.

In the method in Patent Literature 1, as described above, there are the problems that a lot of line resources must be used, and the like.

In the methods in Patent Literatures 2, 3, it is possible to generate the talker position information based on the talker information derived from the microphone. However, the position detection is disturbed by the sound from the speaker that outputs the sound sent from the opposing equipment. Therefore, such a problem existed that, because the sound source is misconceived in the direction different from the actual one, the microphone array (the camera in Patent Literature 3) is directed in the wrong direction.

In the equipment in Patent Literature 4, because the microphones and the speakers are positioned in close vicinity to each other, many detouring sounds from the speakers are contained in the sound collecting signals of respective microphones. Therefore, when the talker direction is specified based on the sound collecting signals of respective microphone and then the sound collecting signal corresponding to the concerned direction is selected, sometimes the talker direction is detected incorrectly because of the presence of detouring sounds.

In the equipment in Patent Literature 5, the talker direction is detected by applying the delay process to the sound collecting signals containing the detouring sound. Therefore, like Patent Literature 4, an influence of the detouring sound cannot be removed and thus sometimes the talker direction is detected in error.

Therefore, it is an object of the present invention to provide a remote conference apparatus capable of estimating a true sound source even when a sound emitted from a speaker that outputs the sound transmitted from the opposing equipment is detoured around a microphone and then collected by the microphone. Also, it is another object of the present invention to provide a sound emitting/collecting apparatus capable of detecting a talker direction precisely by removing an influence of a detouring sound.

Means for Solving the Problems

In the present invention, means for solving above problems are constructed as follows.

(1) A remote conference apparatus of the present invention includes a speaker array, including a plurality of speakers, which emit a sound upward or downward; a first microphone array and a second microphone array which are provided to pick up the sounds from both sides of the speaker array in a longitudinal direction of the speaker array; a first beam generating portion which generates a plurality of first sound collecting beams, the first sound collecting beams placing focal points on a plurality of first sound collecting areas decided previously in the first microphone array side respectively, by applying delay processes to sound signals that microphones of the first microphone array pick up respectively with a predetermined amount of delay respectively and synthesizing delayed sound signals; a second beam generating portion which generates a plurality of second sound collecting beams, the second sound collecting beams placing focal points on a plurality of second sound collecting areas decided previously in the second microphone array side respectively, by applying delay processes to sound signals that microphones of the second microphone array pick up respectively with a predetermined amount of delay respectively and synthesizing delayed sound signals; a difference signal calculating portion which calculates difference signals of the sound collecting beams, that correspond to pairs of sound collecting areas in mutually symmetrical positions with respect to a centerline of the speaker array in the longitudinal direction, out of the sound collecting beams that are generated toward the plurality of first sound collecting areas and the plurality of second sound collecting areas, respectively; a first sound source position estimating portion which selects a pair of sound collecting areas in which a signal strength of the difference signal is large; and a second sound source position estimating portion which selects a sound collecting area corresponding to the sound collecting beam whose strength is larger from the pair of sound collecting areas selected by the first sound source position estimating portion to estimate that a sound source position is present in the selected sound collecting area.

The first beam generating portion and the second beam generating portion generate the first and second sound collecting beams to place the focal point on the sound collecting areas located in symmetrical positions respectively. Also, the sound transmitted from the opposing equipment and output from the speaker arrays are output almost symmetrically to both sides of a pair of microphone arrays respectively. Therefore, it may be considered that the sound output from the speaker array is input substantially equally into the first and second sound collecting beams, and the difference signal calculating portion calculates the difference signal between the first and second sound collecting beams, so that the sound output from the speaker arrays can be canceled. Also, even when a difference between the effective values of the sound collecting beams is calculated, the sound output from the speaker arrays is input substantially equally into the focal points to which the sound collecting beams are directed, so that similarly the sound output from the speaker arrays can be canceled.

Also, the sound input to the microphone array except the sound output from the speaker arrays is never eliminated even when such difference is calculated. By way of typical example, when the talker talks to only the microphone array on one side and the sound collecting beam directed to the talker direction is generated, the sound of the talker is input into one sound collecting beam but such sound is not input into the sound collecting beam on the opposite side. As a result, the sound itself of the talker or the sound in the opposite phase still remains in the calculation of the difference. Also, the sound source is present on both sides, these sounds are different mutually and thus the sounds input into a pair of microphone arrays are asymmetrical in most cases. Therefore, even when such difference is calculated, the sound of the talker still remains. Also, even when the effective value is calculated, similarly the presence of the sound of the talker can be extracted.

The first sound source position estimating portion estimates that a position of the sound source may exist on either of pairs of the sound collecting areas that have the large difference signal. The second sound source position estimating portion compares the sound signals picked up from pairs of the sound collecting areas respectively and estimates on which side the position of the sound source exists. In this manner, according to the present invention, the position of the sound source (containing the sound of the talker. The same is applied hereinafter) can be estimated correctly even though it is possible that the sound output from the speaker is detoured around the microphone and picked up by this microphone.

In this case, the effective value of the sound signal can be derived by calculating a time average of square of a peak value for a particular time period in real time. The signal strength of the difference signal is compared by using a time average of squares of peak values for a predetermined time period, a sum of squares of plural predetermined frequency gains within FFT-transformed gains, and the like. The signal strength of the difference signal of the effective value can be calculated based on a time average of the difference signal between the effective values or a time average of squares of the difference signal by using data obtained for a predetermined time that is longer than that used in calculating the effective value. These are similarly true of following explanations.

(2) In the remote conference apparatus of the present invention, in the invention (1), the first beam generating portion and the second beam generating portion set further a plurality of narrow sound collecting areas in the sound collecting area which is selected by the second sound source position estimating portion to generate a plurality of narrow sound collecting beams that place a focal point on the narrow sound collecting areas respectively. The remote conference apparatus further includes a third sound source position estimating portion which estimates that a sound source position is present in an area of the sound collecting beam in which a strength of the sound signal is large, out of the sound collecting beams corresponding to the plurality of narrow sound collecting areas.

In this invention, a plurality of narrow sound collecting areas are set in the sound collecting areas that are estimated by the second sound source position estimating portion such that the position of the sound source exists there, and then narrow sound collecting beams are generated in the narrow sound collecting areas respectively. The third sound source position estimating portion selects the area whose signal strength is large out of the narrow sound collecting areas. Therefore, the position of the sound source can be estimated in a shorter time than the case where the position of the sound source is estimated finely from the first by narrowing stepwise the position of the sound source.

(3) A remote conference apparatus of the present invention includes a speaker array, including a plurality of speakers, which emit a sound upward or downward; a first microphone array and a second microphone array which are adapted to align a plurality of microphones mutually symmetrically on both sides of a centerline of the speaker array in a longitudinal direction of the speaker array; a difference signal calculating portion which calculates difference signals by subtracting sound signals picked up by respective microphones of the first and second microphone arrays every pair of microphones positioned mutually in symmetrical positions; a first beam generating portion which generates a plurality of first sound collecting beams that place focal points on a plurality of pairs of predetermined sound collecting areas in mutual symmetrical positions respectively, by synthesizing the difference signals mutually while adjusting an amount of delay; a first sound source position estimating portion which selects a pair of sound collecting areas in which a signal strength of the difference signal is large, out of the plurality of pairs of sound collecting areas; second and third beam generating portions which generate sound collecting beams to pick up the sound signals from each sound collecting area in the pair of sound collecting areas that is selected by the first sound source position estimating portion, based on the sound signal picked up by each microphone of the first and second microphone arrays; and a second sound source position estimating portion which selects a sound collecting area corresponding to a sound signal whose signal strength is larger out of the sound signals picked up by the sound collecting beams that the second and third beam generating portions generate to estimate that a sound source position is present in the selected sound collecting area.

In the present invention, at first the difference signal is calculated by subtracting the sound signals picked up by a pair of microphone located in symmetrical positions of the microphone arrays on both sides, and then the beams are generated in plural predetermined directions by using this difference signal. Since the microphone arrays on both sides are arranged bilaterally symmetrically with respect to the speaker array, the sound detoured from the speaker array has already been canceled from the difference signal. The first sound source position estimating portion estimates the position of the sound source based on this difference signal. This estimation may be performed by selecting the sound collecting beam whose signal strength is large out of a plurality of sound collecting beams being generated. It is estimated that the position of the sound source resides in either of a pair of focal point positions when the sound collecting beams are formed by the first and second microphone arrays respectively.

According to the present invention, even when the sound output from the speaker may be detoured around the microphone and picked up by this microphone in the remote conference apparatus, the position of the sound source can be estimated correctly.

(4) A sound emitting/collecting apparatus of the present invention includes a speaker which emits sounds in directions that are symmetrical with respect to a predetermined reference surface respectively; a first microphone array which picks up the sound on one side of the predetermined reference surface, and a second microphone array which picks up the sound on other side of the predetermined reference surface; a sound collecting beam signal generating portion which generates first sound collecting beam signals to pick up the sounds from a plurality of first sound collecting areas based on a sound collecting signal of the first microphone array respectively, and second sound collecting beam signals to pick up the sounds from a plurality of second sound collecting areas provided in symmetrical positions to the first sound collecting areas with respect to the predetermined reference surface based on a sound collecting signal of the second microphone array respectively; and a sound collecting beam signal selecting portion which subtracts the sound collecting beam signals to each other that are symmetrical mutually with respect to the predetermined reference surface, extracts only high-frequency components from two sound collecting beam signals constituting a difference signal whose signal level is highest, and selects one sound collecting beam signal having high-frequency component whose signal level is higher out of the two sound collection beam signals based on a result of the extracted high-frequency components.

According to this configuration, since the first sound collecting beam signals and the second sound collecting beam signals are symmetrical with respect to the reference surface, components of the detouring sounds of the sound collecting beam signals that are symmetrical with respect to a plane have the same magnitude in the direction perpendicular to the reference surface. For this reason, theses detouring sound components are canceled and thus the detouring sound component contained in the difference signal is suppressed. Also, because of the relationship of symmetry with respect to a plane, the signal level of the difference signal derived from a set of sound collecting beam signals that are not directed in the sound source (talker) direction is almost 0 whereas the signal level of the difference signal derived from a set of sound collecting beam signals one of which is directed in the sound source direction is at a high level. Therefore, the position of the sound source that is in parallel with the reference surface and along the microphone aligning direction of the microphone arrays can be selected by selecting the difference signal of a high level. Then, the position of the sound source in the direction that intersects orthogonally with the reference surface is detected by comparing the signal levels of two sound collecting beam signals from which the difference signal is detected. At this time, the influence of the sound detoured from the speaker can be eliminated by using only the high-frequency component. This is because a high-frequency band is restricted in the common communication network to which this sound emitting/collecting apparatus is connected and because the high-frequency component of the sound collecting beam signal is created only by the voice from the talker.

(5) In the sound emitting/collecting apparatus of the present invention, in the invention (4), the sound collecting beam signal selecting portion includes: a difference signal detecting portion which subtracts the sound collecting beam signals to each other that are symmetrical mutually to detect a difference signal whose signal level is highest; a high-frequency component signal extracting portion which has high-pass filters that pass only high-frequency components of two sound collecting beam signals from which the difference signal is detected by the difference signal detecting portion respectively, and detects the high-frequency component signal whose signal level is higher from the high-frequency component signals that passed through the high-pass filters; and a selecting portion which selects the sound collecting beam signal corresponding to the high-frequency component signal detected by the high-frequency component signal extracting portion, and outputs the selected sound collecting beam signal.

According to this configuration, the difference signal detecting portion, the high-frequency component signal extracting portion having high-pass filters, and the selecting portion are provided as the concrete configuration of the above-mentioned sound collecting beam signal selecting portion. The difference signal detecting portion subtracts the sound collecting beam signals generated symmetrically and detects the difference signal of a high level. The high-frequency component signal extracting portion detects the high-frequency component signal whose signal level is higher out of the high-frequency component signals obtained by applying the high frequency passing process to the sound collecting beam signals from which the difference signal is detected. The selecting portion selects the sound collecting beam signal corresponding to the detected high-frequency component signal from two sound collecting beam signals from which the difference signal is detected.

(6) In the sound emitting/collecting apparatus of the present invention, in the invention (4), the first microphone array and the second microphone array are constructed by a microphone array in which a plurality of microphones are aligned linearly along the predetermined reference surface respectively.

According to this configuration, the microphone arrays are constructed along the predetermined reference surface. Therefore, merely simple signal processes such as the delay process, etc. may be applied to respective sound collecting signals when the sound collecting beam signals are to be generated based on the sound collecting signals from respective microphones.

(7) In the sound emitting/collecting apparatus of the present invention, in the invention (4) or (5), the speaker is constructed by a plurality of separate speakers aligned linearly along the predetermined reference surface.

According to this configuration, a plurality of separate speakers are aligned along the predetermined reference surface. Therefore, the sounds can be emitted more easily symmetrically with respect to the predetermined reference surface.

(8) The sound emitting/collecting apparatus of the present invention, in the invention (4) or (5), further includes a detouring sound removing portion which executes control such that the sound emitted from the speaker is not contained in the output sound signal, based on the input sound signal and the sound collecting beam signal selected by the sound collecting beam signal selecting portion.

According to this configuration, the detouring sound component can be removed further from the sound collecting beam signals being output from the sound collecting beam signal selecting portion.

According to the present invention, the sound emitting/collecting apparatus capable of detecting the direction of the sound source such as the talker, or the like exactly and picking up the sound in that direction effectively can be constructed independent of the emitted sound signals.

BEST MODE FOR CARRYING OUT THE INVENTION

First Embodiment

A configuration and a using mode of a remote conference apparatus as a first embodiment of the present invention will be explained with reference to FIGS. 1A to 1C hereinafter. The remote conference apparatus of the first embodiment provides such an equipment that a sound transmitted from the opposing equipment is output by using a speaker array to reproduce a position of a talker on the opposing equipment side, while a voice of a talker is picked up by using a microphone array to detect a position of the talker and then the picked-up voice and position information are transmitted to the opposing equipment.

Figure 1A:
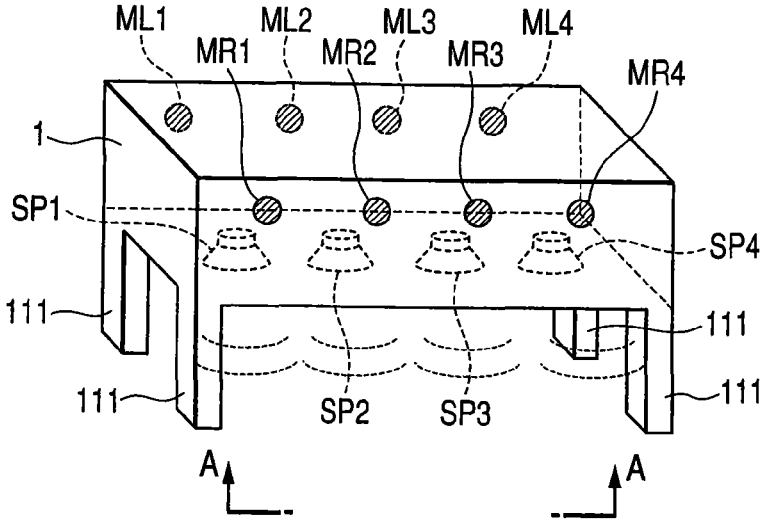
[FIG. 1A] A view showing an external perspective view of a remote conference apparatus according to a first embodiment of the present invention.
Figure 1B:
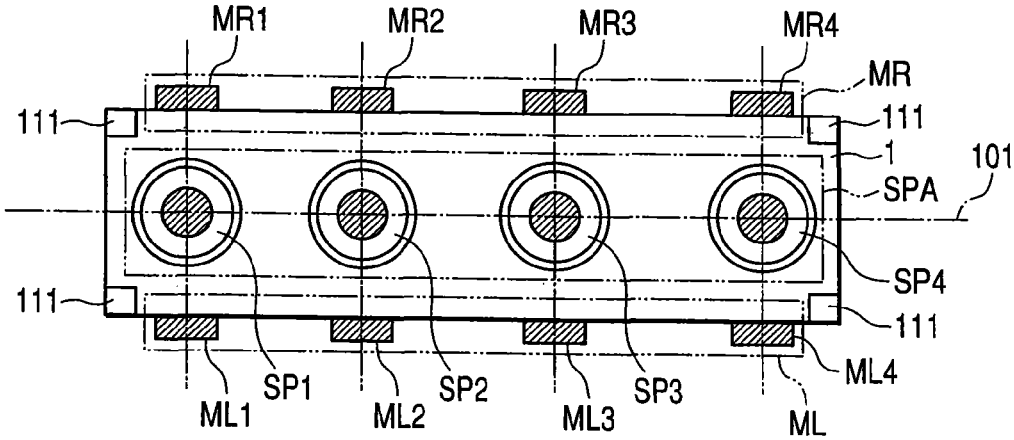
[FIG. 1B] A bottom view showing the same remote conference apparatus, taken along an A-A arrow line.
Figure 1C:
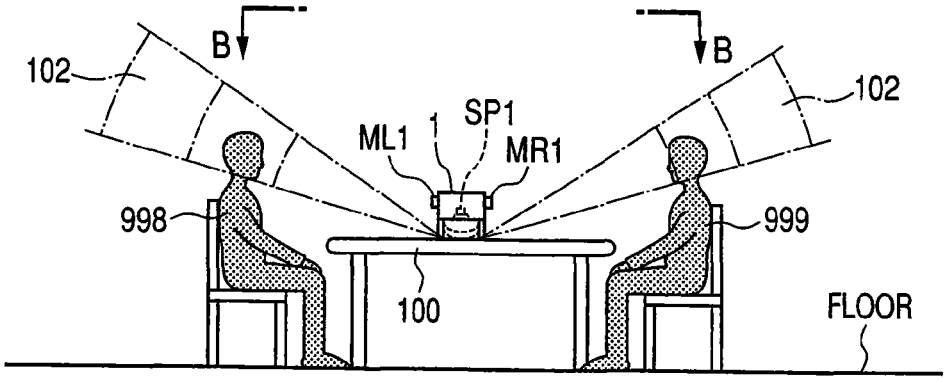
[FIG. 1C] A view showing a using mode of the same remote conference apparatus.

FIGS. 1A to 1C shows an external view and a using mode of this remote conference apparatus. FIG. 1A is an external perspective view of the remote conference apparatus, and FIG. 1B is a bottom view showing the remote conference apparatus, taken along an A-A arrow line. Also, FIG. 1C is a view showing a using mode of the remote conference apparatus.

As shown in FIG. 1A, a remote conference apparatus 1 has a rectangular-parallelepiped main body and legs 111. A main body of the remote conference apparatus 1 is supported and lifted from an installing surface at a predetermined interval by the legs 111. A speaker array SPA constructed by aligning a plurality of speakers SP1 to SP4 in the longitudinal direction of the main body as the rectangular parallelepiped is provided downward to a bottom surface of the remote conference apparatus 1. The sound is output downward by this speaker array SPA from a bottom surface of the remote conference apparatus 1, and then this sound is reflected by the installing surface of the session desk, and the like and then arrives at attendances of the session (see FIG. 1C).

Also, as shown in FIGS. 1A and 1B, a microphone array constructed by aligning the microphones is provided to both side surfaces of the main body in the longitudinal direction (both side surfaces are referred to as a right side surface (an upper side in FIG. 1B) and a left side surface (a lower side in FIG. 1B) hereinafter) respectively. That is, a microphone array MR consisting of microphones MR1 to MR4 is provided to the right side surface of the main body, and a microphone array ML consisting of microphones ML1 to ML4 is provided to the left side surface of the main body. The remote conference apparatus 1 picks up the talking voice of the attendance of the session as the talker and detects the position of the talker by using these microphone arrays MR, ML.

Although the illustration is omitted from FIG. 1A, a transmitting portion 2 (see FIG. 4) and a receiving portion 3 (see FIG. 6) are provided in the interior of the remote conference apparatus 1. This transmitting portion 2 estimates a position of the talker (not only a human voice but also a sound generated from an object may be employed. This is true of the following description) by processing the sound picked up by the microphone arrays MR, ML, and then multiplexes the position with the sound picked up by the microphone arrays MR, ML and transmits the sound. This receiving portion 3 outputs the sound received from the opposing equipment as a beam from the speakers SP1 to SP4.

Here, in FIG. 1B, the microphone arrays MR, ML are provided in symmetrical positions about a centerline 101 of the speaker array SPA. But these arrays are not always provided symmetrically in the equipment in the first embodiment. Even though the microphone arrays MR, ML are provided bilaterally asymmetrically, the signal processing may be executed in the transmitting portion 2 (see FIG. 4) such that the left and right sound collecting areas are formed bilaterally symmetrically (see FIG. 3).

Next, a using mode of the remote conference apparatus 1 will be explained with reference to FIG. 1C hereunder. Normally the remote conference apparatus 1 is put on a center of a session desk 100 in use. A talker 998 or/and a talker 999 is/are seated on one side or both sides of the session desk 100. The sound that the speaker array SPA outputs is reflected by the session desk 100 and arrives at the left and right talkers. In this case, because the speaker array SPA outputs the sound as a beam, the sound can be pinpointed in a particular position with respect to the left and right talkers. Details of a beam-shaping process of the sound by the speaker array SPA will be described later.

Also, the microphone arrays MR, ML pick up the voice of the talker. A signal processing portion (transmitting portion 2) connected to the microphone arrays MR, ML detects the position of the talker based on difference in timings of the sounds being input into respective the microphone units MR1 to MR4, ML1 to ML4.

Also, in FIGS. 1A to 1C, for easiness of illustration, the number of the speakers and the number of the microphones are set to four respectively. But these numbers are not limited to four, and one or many speakers and microphones may be provided. Also, the microphone arrays MR, ML and the speaker array SPA may provided in not one row but plural rows. For this reason, in the following explanation, each speaker of the speaker array and each microphone of the microphone array are represented by using a subscript such that the speakers SP1 to SPN are given by SPi (i=1 to N) and the microphones ML1 to MLN are given by MLi (i=1 to N), for example. That is, i=1 in SPi (i=1 to N) corresponds to SP1.

Then, a beam-shaping process of the sound by the speaker array SPA, i.e., the sound emitting beam, and the sound collecting beam that the microphone arrays ML, MR form respectively will be explained with reference to FIGS. 2A, 2B hereunder.

Figure 2A:
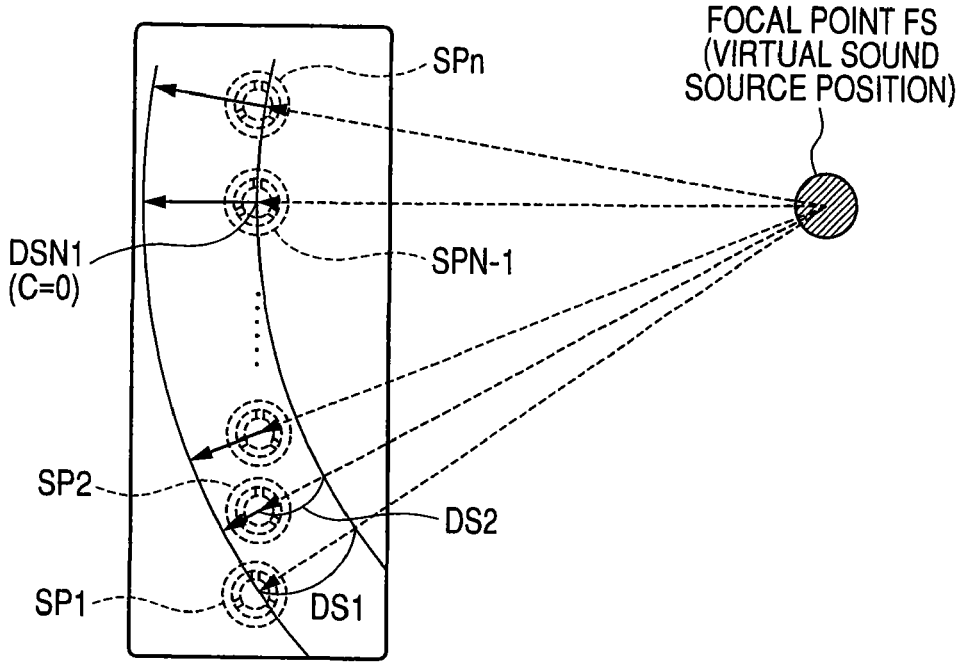
[FIG. 2A] A view explaining sound emitting beams in the same remote conference apparatus.

FIG. 2A is a view explaining sound emitting beams. The signal processing portion (the receiving portion 3) supplies the sound signal to respective speaker units SP1 to SPN of the speaker array SPA. This signal processing portion delays the sound signal received from the opposing equipment by delay times DS1 to DSN, as shown in FIG. 2A, and supplies delayed signals to the speaker units SP1 to SPN. In FIG. 2A, the speaker located closest to a virtual sound source position (focal point FS) emits the sound without a delay time, and a delay pattern is given to respective speakers such that each speaker emits the sound via a delay time corresponding to the distance as the speaker is distant farther from the virtual sound source position. Because of this delay pattern, the sounds output from respective speaker units SP1 to SPN spread to form the same wavefront as the sound emitted from the virtual sound source in FIG. 2A. Therefore, the attendance of the session as the user can hear the sound as if the talker on the opposing side is located in a position of the virtual sound source.

Figure 2B:
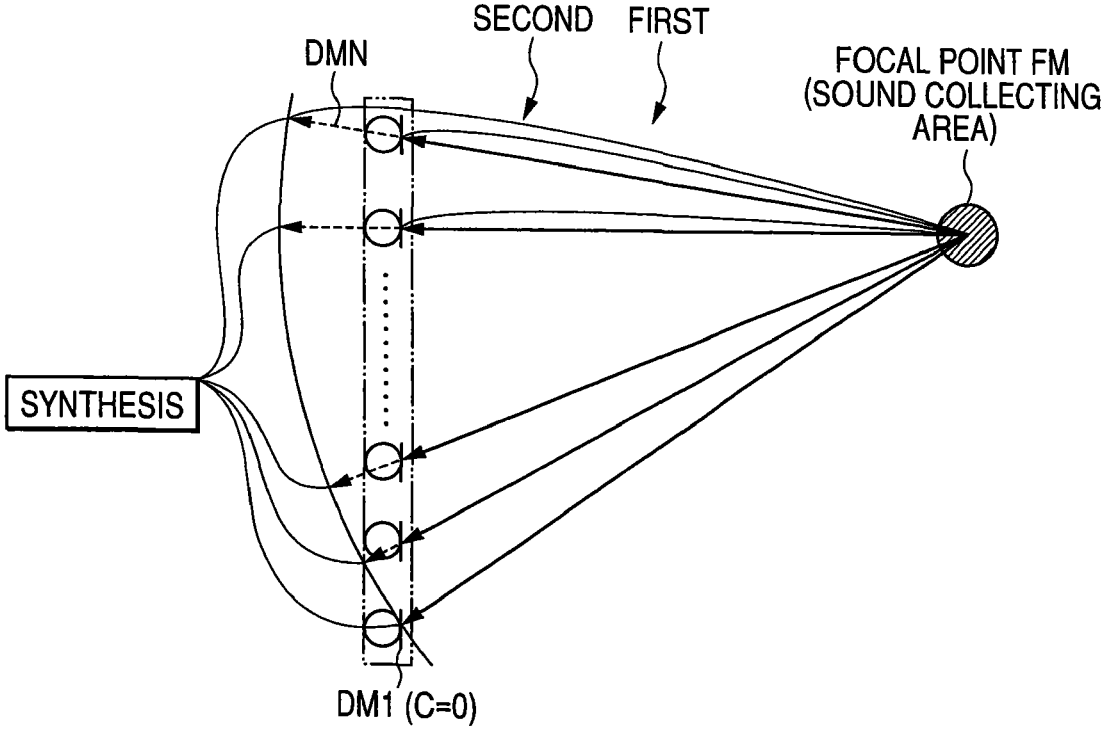
[FIG. 2B] A view explaining sound collecting beams in the same remote conference apparatus.

FIG. 2B is a view explaining sound collecting beams. The sound signals input into respective microphone units MR1 to MRN are delayed by delay times DM1 to DMN respectively, as shown in FIG. 2B, and then synthesized. In FIG. 2B, the sound picked up by the microphone located farthest a sound collecting area (focal point FM) is input into an adder without a delay time, and a delay pattern is given to the sound signals picked up by respective microphones such that each sound is input into the adder via a shorter delay time in response to the distance as the sound comes closer to the sound collecting area. Because of this delay pattern, respective sound signals are at equal distances in sound wave propagation from the sound collecting area (focal point FM), and respective sound signals when synthesized are produced such that the sound signals are emphasized in phase in the sound collecting area and the sound signals are cancelled mutually by phase displacement in the other area. In this manner, since the sounds input into a plurality of microphones are delayed such that respective sounds are at equal distances in sound wave propagation from the sound collecting area and then synthesized, only the sound from the sound collecting area can be picked up.

In the remote conference apparatus of the present embodiment, the microphone arrays MR, ML shape simultaneously the sound collecting beam with respect to a plurality of sound collecting areas (four in FIG. 3) respectively. As a result, the voice of the talker can be picked up no matter where the talker positions in the sound collecting area, and a position of the talker can be detected according to the sound collecting area from which the voice can be picked up.

Figure 3:
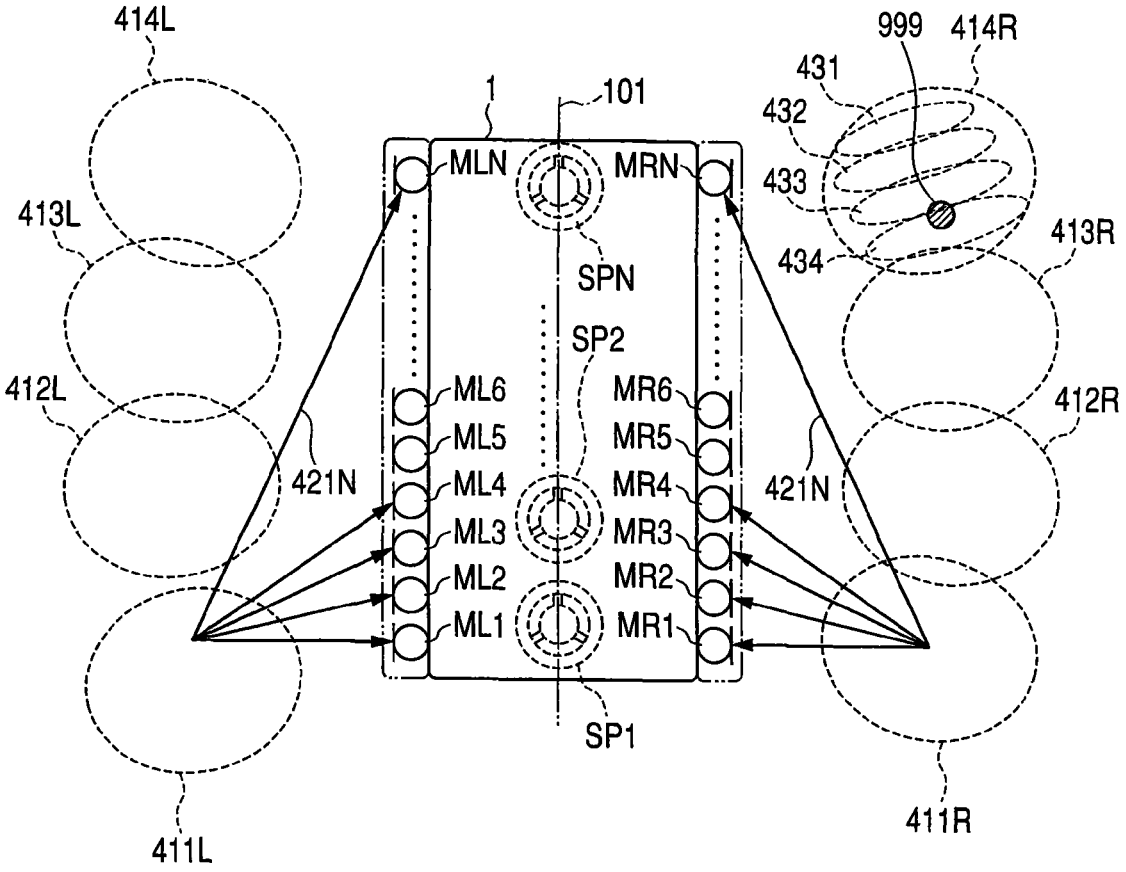
[FIG. 3] A view explaining a sound collecting area that is set in a microphone array of the same remote conference apparatus.

Next, a sensing of the sound source position by the sound collecting beam and an operation for collecting a sound from the sound source position will be explained with reference to FIG. 3 hereunder. FIG. 3 is a plan view of the remote conference apparatus and the talker, when viewed from the top. That is, FIG. 3 is a view taken along a B-B arrow line in FIG. 1C, and explaining a mode of the sound collecting beam formation by a microphone array.

<<Explanation of the Sound Source Position Sensing/Sound Collecting Equipment Excluding the Demon Sound Source>>

First, the principle of the sound source position sensing and sound collecting equipment of the remote conference apparatus will be explained hereunder. In this explanation, assume that the sound beam is not being output from the speaker array SPA.

Here, a process applied to the sound collecting signal of the microphone array MR on the right side surface will be explained hereunder. The transmitting portion 2 (see FIG. 4) of the remote conference apparatus 1 forms the sound collecting beams having sound collecting areas 411 to 414 as a focal point by the above mentioned delay synthesis. These plural sound collecting areas are decided by assuming positions where the talker who attends the session using the remote conference apparatus 1 may exist.

It may be considered that the talker (sound source) is present in the area whose level of the picked-up sound signal is largest out of these sound collecting areas 411R to 414R. For example, as shown in FIG. 3, when the sound source 999 is present in the sound collecting area 414R, the sound signal picked up from the sound collecting area 414R becomes higher in level than the sound signals picked up from other sound collecting areas 411R to 413R.

Similarly, as to the microphone array ML on the left side surface, four-system sound collecting beams are formed axially symmetrically with the right side surface, and then the area whose sound signal level of the picked-up sound is highest out of the sound collecting areas 411L to 414L is detected. In this case, a line of the axial symmetry is set to coincide substantially with an axis of the speaker array SPA.

With the above, the principle of the sound source position sensing and sound collecting equipment of the remote conference apparatus of the present embodiment is explained.

In a situation that the sound is not emitted from the speaker array SPA and the microphone arrays MR, ML do not pick up the detouring sound, the sound source position sensing and the sound collection can be executed rightly according to the principle. The remote conference apparatus 1 transmits/receives the sound signal in two ways, and also the sound is emitted from the speaker array SPA in parallel with the sound collection by the microphone arrays MR, ML.

The delay pattern, as shown in FIG. 2A, is given to the sound signals supplied to respective speakers of the speaker array SPA such that the same wavefront as the case where the sound arrives at from the virtual sound source position being set at the rear of the speaker array is formed. In contrast, the sound signals picked up by the microphone array MR are delayed in a pattern shown in FIG. 2B and then synthesized such that the synthesized sound signal coincides in timing with the sound signal that arrives at from a predetermined sound collecting area.

Here, when the virtual sound source position of the speaker array coincides with any one of plural sound collecting areas of the microphone array MR, the delay pattern given to respective speakers SP1 to SPN of the speaker array SPA has just a reversed relationship with the delay pattern given to the sound collecting areas where the sound signals are picked up by the microphone array MR. Therefore, the sound signals emitted from the speaker array SPA, then detours around the microphone array MR, and then are picked up by the array are synthesized at high level.

In case the sound signals are processed by the common sound source detecting system described above, such a problem exists that the detoured sound signal synthesized at high level is misconceived as the sound source that is not essentially present (the demon sound source).

Therefore, unless this demon sound source is canceled, the sound signal that arrived at from the opposing equipment is returned as it is to cause the echo. Also, the sound of the true sound source (talker) cannot be detected and picked up.

The above explanation is about the microphone array MR. But the explanation about the microphone array ML can be similarly given (because the microphone array MR, ML are bilaterally symmetrical).

That is, the sound beam is reflected by the session desk 100 and then radiated bilaterally symmetrically. Therefore, the demon sound source is similarly generated on the right-side microphone array MR and the left-side microphone array ML bilaterally symmetrically.

For this reason, when a sound volume level is similarly high in left and right corresponding areas even though it is estimated by comparing the left-side sound collecting areas 411L to 414L and the right-side sound collecting areas 411R to 414R mutually that the sound volume level may be high and also the sound source may exist, this sound source is decided as the demon sound source generated by the detoured sound beam of the speaker array SPA. Thus, this sound source is removed from the objections of sound collection. As a result, it is possible to detect and collect the sound from the true sound source, and also it is possible to prevent the echo generated by the detouring sound.

For this purpose, the transmitting portion 2 of the remote conference apparatus 1 compares a level of the sound signals picked up from the sound collecting areas 411L to 414L on the left-side microphone array ML with a level of the sound signals picked up from the sound collecting areas 411R to 414R on the right-side microphone array MR. Then, when levels are largely different in the left and right sound collecting areas after pairs of the left and right sound collecting areas having the substantially equal levels of the sound signals are removed, the transmitting portion 2 decides that the sound source is present in the sound collecting areas the level of which is larger.

The equipment transmits only the sound signal having the larger level to the opposing equipment, and also adds position information indicating a position of the sound collecting area from which the sound signal is detected to a subcode of the signal (the digital signal), or the like.

A configuration of the signal processing portion (transmitting portion) for executing the above demon sound source excluding process will be explained hereunder. In this case, the narrow sound collecting beams 431 to 434 in FIG. 3 will be explained together with explanation of a second embodiment in FIG. 7.

<<Configuration of the Transmitting Portion Forming Sound Collecting Beam>>

Figure 4:
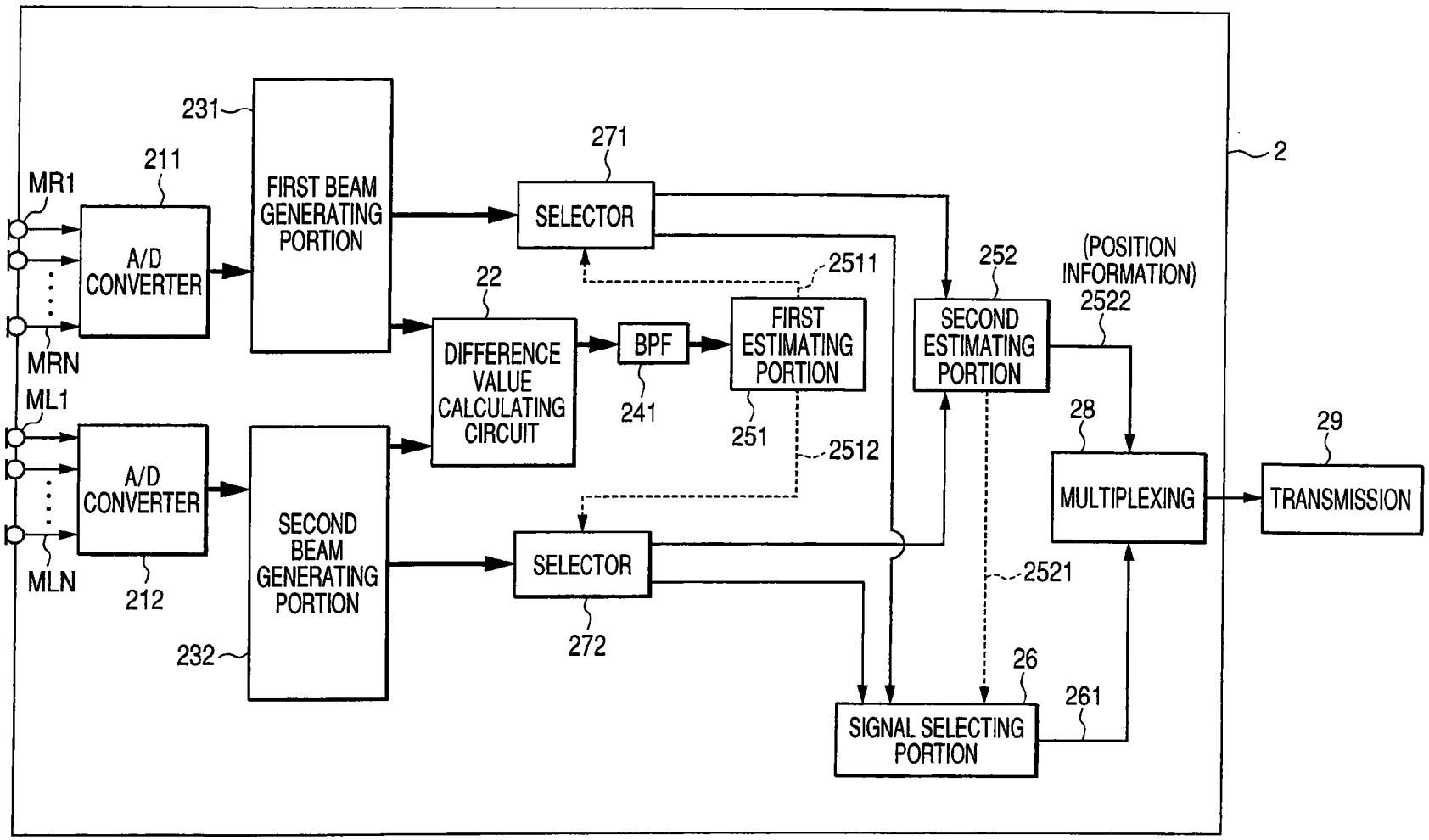
[FIG. 4] A block diagram of a transmitting portion of the same remote conference apparatus.

FIG. 4 is a block diagram of a configuration of a transmitting portion 2 of the remote conference apparatus 1. Here, a thick-line arrow indicates that the sound signals in plural systems are transmitted, and a thin-line arrow indicates that the sound signals in one system is transmitted. Also, a broken-line arrow indicates that the instruction input is transmitted.

A first beam generating portion 231 and a second beam generating portion 232 in FIG. 4 correspond to the signal processing portion that forms four-system sound collecting beams having the left and right sound collecting areas 411R to 414R, 411L to 414L shown in FIG. 3 as a focal point respectively.

The sound signals that microphone units MR1 to MRN of the right-side microphone array MR pick up are input to the first beam generating portion 231 via an A/D converter 211. Similarly, the sound signals that microphone units ML1 to MLN of the left-side microphone arrays ML pick up are input to the second beam generating portion 232 via an A/D converter 212.

The first beam generating portion 231 and the second beam generating portion 232 form four sound collecting beams respectively, pick up the sounds from four sound collecting areas 411R to 414R, 411L to 414L respectively, and output the picked-up sound signals to a difference value calculating circuit 22 and selectors 271, 272.

Figure 5:
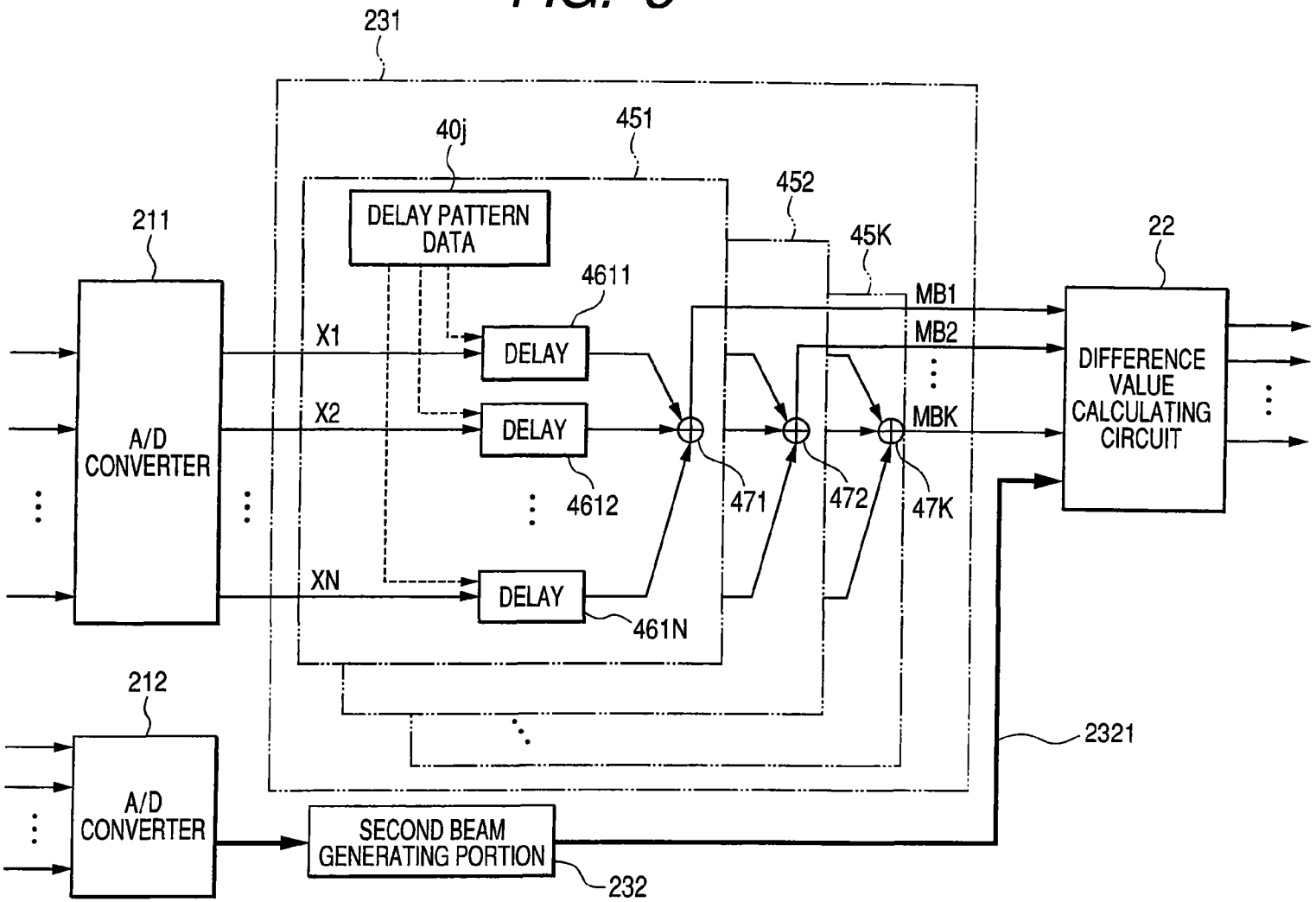
[FIG. 5] A configurative view of a first beam generating portion of the same remote conference apparatus.

FIG. 5 is a view showing a detailed configuration of the first beam generating portion 231. The first beam generating portion 231 has a plurality of delay processing portions 45*j* corresponding to respective sound collecting areas 41*j* (j=1 to K). In order to generate sound collecting beam outputs MBj having the focal point in respective sound collecting areas 41*j* (j=1 to K), respective delay processing portions 45*j* delay the sound signal every microphone output based on delay pattern data 40*j*. The delay processing portions 45*j* receive the delay pattern data 40*j* stored in ROM, and set an amount of delay to delays 46*ji* (j=1 to K, i=1 to N) respectively.

An adder 47*j* (j=1 to K) adds digital sound signals that are subject to the delay, and outputs resultant signals as the microphone beam outputs MBj (j=1 to K). The sound collecting beam outputs MBj constitute the sound collecting beams that bring the sound collecting areas 41*j* shown in FIG. 3 into focal point respectively. Then, the microphone beam outputs MBj that respective delay processing portions 45*j* calculate are output to the difference value calculating circuit 22, and the like respectively.

Also, the first beam generating portion 231 is explained in FIG. 5, but a second beam generating portion 232 has a similar configuration to the above configuration.

In FIG. 4, the difference value calculating circuit 22 calculates a difference value by comparing the sound volume levels between the sound signals that are picked up in bilaterally symmetrical positions out of the sound signals picked up in respective sound collecting areas. More particularly, the difference value calculating circuit 22 calculates difference values $$D(411)=|P(411R)-P(411L)|$$

$$D(412)=|P(412R)-P(412L)|$$

$$D(413)=|P(413R)-P(413L)|$$

$$D(414)=|P(414R)-P(414L)|$$

where P(A) is a signal level of the sound collecting area A. The difference value calculating circuit 22 outputs these calculated difference values D(411) to D(414) to a first estimating portion 251.

In this case, the difference value calculating circuit 22 may be constructed to output the difference value signal by subtracting signal waveforms of the sound signals picked up from the left and right sound collecting areas as they are. Also, the difference value calculating circuit 22 may be constructed to output a subtracted value of sound volume level values, which are derived by integrating effective values of the sound signals picked up from the left and right sound collecting areas for a predetermined time, every predetermined time period.

When the difference value calculating circuit 22 outputs the difference value signal, a BPF 241 may be inserted between the difference value calculating circuit 22 and the first estimating portion 251 to make estimation in the first estimating portion 251 easy. This BPF 241 is set to pass through a frequency band around 1 kHz to 2 kHz, within which directivity control of the sound collecting beam can be handled finely, out of the frequency range of the talking voice.

In this manner, the sound volume levels of the sound collecting signals picked up from the left and right sound collecting areas that are positioned bilaterally symmetrically with respect to a centerline of the speaker array SPA are subtracted mutually. Thus, sound components detoured bilaterally symmetrically around the left and right microphone arrays ML, MR from the speaker array SPA are canceled mutually. As a result, the detoured sound signal is never misconceived as the demon sound source.

The first estimating portion 251 selects the maximum value of the difference values being input from the difference value calculating circuit 22, and then selects a pair of sound collecting areas from which the maximum difference value. In order to input the sound collecting areas into a second estimating portion 252, the first estimating portion 251 outputs select signals, which cause to output the sound signals in these sound collecting areas to the second estimating portion 252, to the selectors 271, 272.

The selector 271 selects the signal based on this select signal such that the signal of the sound collecting area selected by the first estimating portion 251 from the signals of four sound collecting areas being picked up by the first beam generating portion 231 as the beam can be supplied to the second estimating portion 252 and a signal selecting portion 26. Also, the selector 272 selects the signal based on this select signal such that the signal of the sound collecting area selected by the first estimating portion 251 from the signals of four sound collecting areas being picked up by the second beam generating portion 232 as the beam can be supplied to the second estimating portion 252 and the signal selecting portion 26.

The second estimating portion 252 receives the sound signals of the sound collecting areas being estimated by the first estimating portion 251 and output selectively from the selectors 271, 272. The second estimating portion 252 compares the input sound signals in the left and right sound collecting areas, and then decides the sound signal of a larger level as the sound signal from the true sound source. The second estimating portion 252 outputs information indicating the direction and the distance of the sound collecting area where this true sound source is present to a multiplexing portion 28 as position information 2522, and instructs the signal selecting portion 26 to input the sound signal from the true sound source selectively into the multiplexing portion 28.

The multiplexing portion 28 multiplexes the position information 2522 input from the second estimating portion 252 with a sound signal 261 of the true sound source selected by the signal selecting portion 26, and transmits this multiplexed signal to the opposing equipment.

These estimating portions 251, 252 execute estimation of the sound source positions every predetermined period repeatedly. For example, the estimation is repeated every 0.5 sec. In this case, signal waveform or amplitude effective values in a 0.5 second period may be compared mutually. If the sound collecting area is changed by estimating the sound source position every predetermined period repeatedly in this manner, the sound can be collected in response to movement of the talker.

In this case, when the true sound source position and the demon sound source position generated by the detouring are superposed with each other, a difference signal between left and right signal waveforms may be output to the opposing equipment as the sound collecting signal. This is because the difference signal cancels only the demon sound source waveform and maintains the signal waveform of the true sound source.

Also, in order to respond to the case where the talker exists over two sound collecting areas or the case where the talker moves, another mode given as follows may be considered. The first estimating portion 251 selects two sound collecting areas in order of larger strength of the difference signal, and also outputs a strength ratio between them. The second estimating portion 252 compares pairs whose signal strength is maximum or two pairs, and estimates on which side the true sound source resides. The signal selecting portion 26 multiplies two sound signals selected by the first estimating portion 251 and the second estimating portion 252 on one side by a weight of the indicated strength ratio, then synthesizes resultant sound signals, and then outputs a synthesized signal as the output signal 261. In this manner, when the sound signals in two positions are always synthesized while giving a weight by the signal strength ratio, the cross fade is always applied to movement of the talker like the above, and thus localization of a sound image moves naturally.

<<Configuration of Receiving Portion 3 Forming Sound Beam>>

Figure 6:
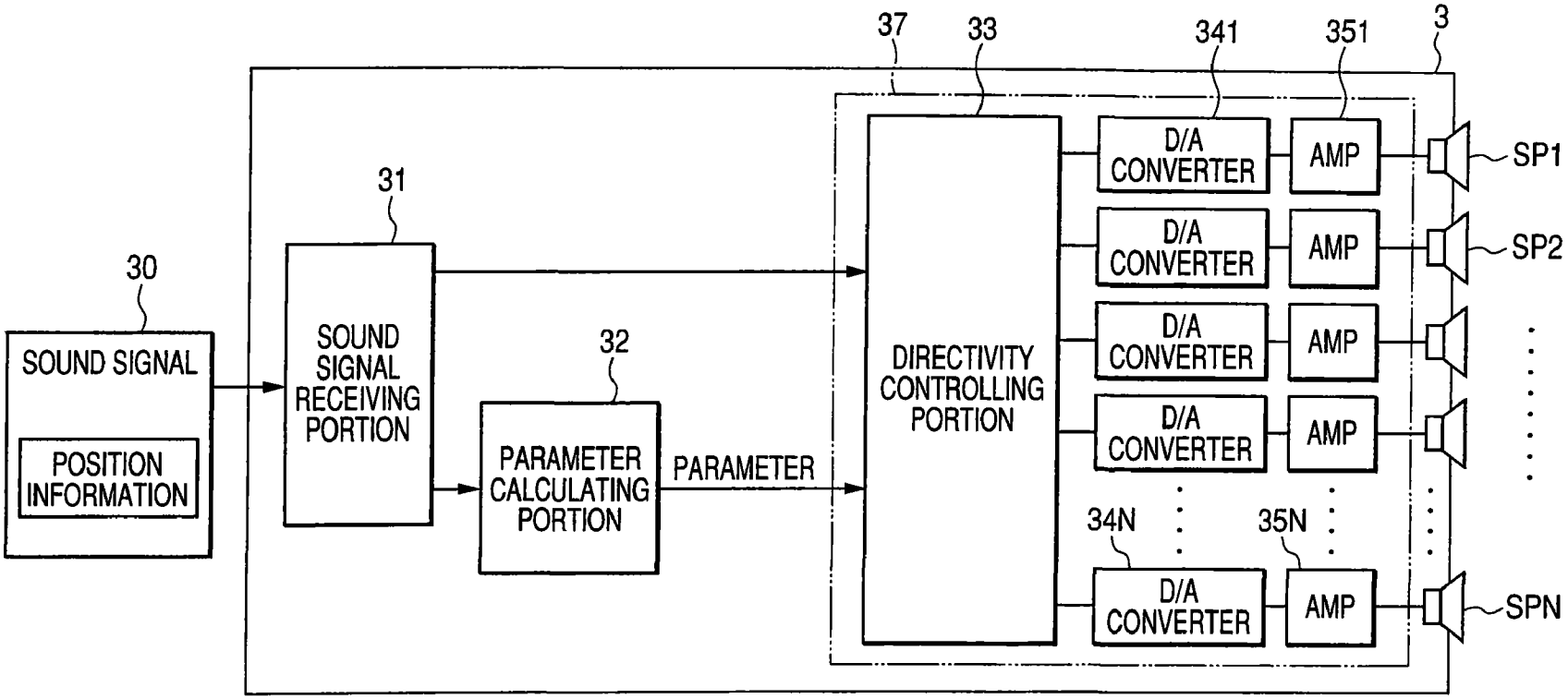
[FIG. 6] A block diagram of a receiving portion of a remote conference apparatus.

Next, an internal configuration of the receiving portion 3 will be explained with reference to FIG. 6 hereunder. The receiving portion 3 includes a sound signal receiving portion 31 for receiving the sound signal from the opposing equipment and separating the position information from the subcode of the sound signal, a parameter calculating portion 32 for deciding the position, in which the sound signal is localized, based on the position information that the sound signal receiving portion 31 separated and calculating a directivity control parameter used to localize the sound image in that position, a directivity controlling portion 33 for controlling a directivity of the received sound signal based on the parameter input from the parameter calculating portion 32, a D/A converter 34*i* (i=1 to N) for converting the sound signal whose directivity is controlled into an analog signal, and an amplifier 35*i* (i=1 to N) for amplifying the analog sound signal being output from the D/A converter 34*i* (i=1 to N). An analog sound signal that the amplifier 35*i* outputs is supplied to external speaker SPi (i=1 to N) shown in FIGS. 1A to 1C.

The sound signal receiving portion 31 is a function portion for holding communicating with the opposing equipment via the Internet, the public telephone line, or the like, and has a communication interface, a buffer memory, etc. The sound signal receiving portion 31 receives a sound signal 30 containing the position information 2522 as the subcode from the opposing equipment. The sound signal receiving portion 31 separates the position information from the subcode of the received sound signal and inputs it to the parameter calculating portion 32, and inputs the sound signal to the directivity controlling portion 33.

The parameter calculating portion 32 is a calculating portion for calculating a parameter used in the directivity controlling portion 33. The parameter calculating portion 32 calculates each amount of delay given to the sound signals supplied to the speakers respectively such that the focal point is generated in the position decided based on the received position information and the directivity is given to the sound signal in such a fashion that the sound signal is emitted from this focal point.

The directivity controlling portion 33 processes the sound signal received by the sound signal receiving portion 31 based on the parameter set by the parameter calculating portion 32 every output system of the speaker SPi (i=1 to N). That is, a plurality of processing portions corresponding to the speaker SPi (i=1 to N) respectively are provided in parallel. Each processing portion sets an amount of delay, etc. to the sound signal based on the parameter (delay amount parameter, etc.) that the parameter calculating portion 32 calculates, and outputs the amount of delay to the D/A converter 34*i* (i=1 to N) respectively.

The D/A converter 34*i* (i=1 to N) converts the digital sound signal output from the directivity controlling portion 33 every output system into the analog signal, and outputs the analog signal. The amplifier 35*i* (i=1 to N) amplifies the analog signal being output from the D/A converter 34*i* (i=1 to N) respectively, and outputs the amplified signal to the speaker SPi (i=1 to N).

In order to reproduce a positional relationship of the sound source in the opposing equipment by the own equipment, the receiving portion 3 explained as above carries out the processes of shaping the sound signal received from the opposing equipment into the beam based on the position information and outputting the sound signal from the speaker array SPA provided to a bottom surface of the equipment main body to reproduce the directivity in such a fashion that the sound is output from the virtual sound source position.

Second Embodiment

Figure 7:
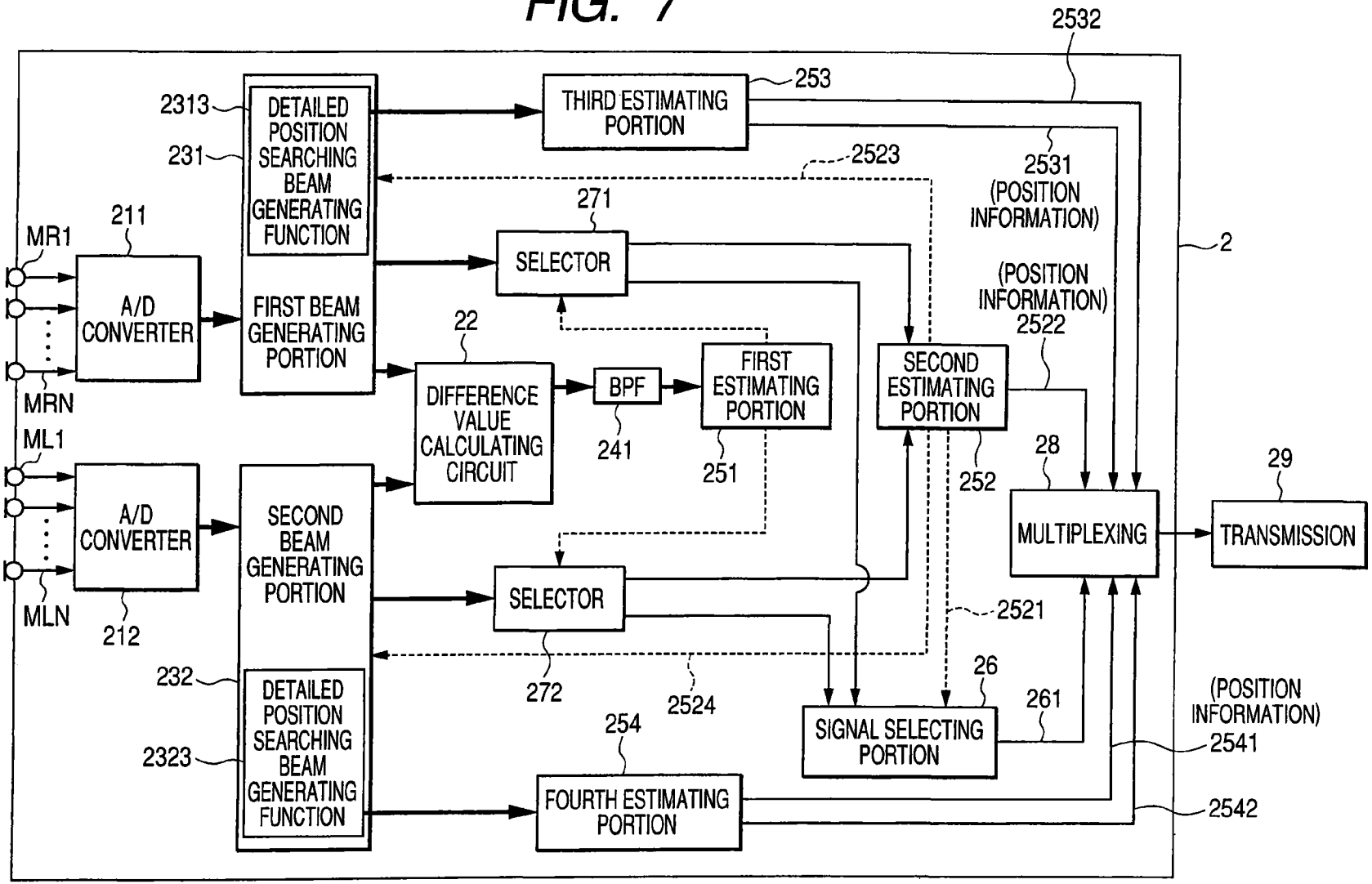
[FIG. 7] A block diagram of a transmitting portion of a remote conference apparatus according to a second embodiment of the present invention.

Next, a remote conference apparatus according to a second embodiment will be explained with reference to FIG. 7 hereunder. This embodiment is an application of the first embodiment shown in FIG. 4, and their explanation will be applied correspondingly by affixing the same reference symbols to the same portions. Also, FIG. 3 is referred auxiliarily to in explanation of the sound collecting beam.

In the first embodiment, the second estimating portion 252 estimates on which side the true sound source exists on the assumption that the true sound source resides in either of pairs of sound collecting areas whose difference signal is large. In the second embodiment, the first beam generating portion 231 and the second beam generating portion 232 have detailed position searching beam (narrow beam) generating functions 2313, 2323 of searching in detail the sound collecting area in which the true sound source that the second estimating portion 252 estimated exists to detect the sound source position exactly respectively.

As shown in FIG. 3, when the second estimating portion 252 estimated that the true sound source 999 exists in the sound collecting area 414R, such second estimating portion 252 notifies the first beam generating portion 231 of this estimated result. In this manner, because the second estimating portion 252 estimates on which side of the microphone arrays MR, ML the true sound source is present, one of estimated result notifications 2523, 2524 is input only into either of the first and second beam generating portions 231, 232. In case it is estimated that the true sound source is present on the left side area, the second estimating portion 252 notifies the second beam generating portion 232 of the estimated result.

The first beam generating portion 231 operates the detailed position searching beam generating function 2313 based on this notification to generate the narrow beams having narrow sound collecting beams 431 to 434 shown in FIG. 3 as the focal point respectively. Thus, the first beam generating portion 231 searches in detail the position of the sound source 999.

Also, the equipment of the second embodiment is equipped with a third estimating portion 253 and a fourth estimating portion 254. The third and fourth estimating portions 253, 254 select two sound collecting beams from the sound collecting beams being output from the detailed position searching beam generating functions 2313, 2323 in order of higher signal strength. In this case, it is only the portion that the second estimating portion 252 estimated that operates out of the estimating portions 253, 254.

In an example in FIG. 3, the sound signal is picked up from the sound collecting beams directed to the narrow sound collecting areas 431 to 434, and the true sound source 999 resides in the position that spreads over the sound collecting area 434 and the sound collecting area 433. In this case, the third estimating portion 253 selects the sound signals picked up from the sound collecting areas 434, 433 in order of higher signal strength. The third estimating portion 253 estimates the position of the talker by proportionally distributing the focal point position of the selected sound collecting area in response to the signal strengths of two selected sound signals and outputs it. Also, the third estimating portion 253 synthesizes two selected sound signals while giving a weight and outputs the synthesized signal as the sound signal.

With the above, the first beam generating portion 231 (the detailed position searching beam generating function 2313) and the third estimating portion 253 in the right-side area are explained. The second beam generating portion 232 (the detailed position searching beam generating function 2323) and the fourth estimating portion 254 in the left-side area are constructed similarly, and carry out the similar processing operations.

In some cases the process in the detailed position searching function of the equipment in the second embodiment shown in the above cannot keep up the movement when the talker moves frequently. Therefore, such a situation may be considered that this function should be operated only when the position of the talker output from the second estimating portion 252 stays for a predetermined time. In this case, when the position of the talker output from the second estimating portion 252 moves within a predetermined time, the similar operation to that in the first embodiment shown in FIG. 4 may be carried out even though the arrangement shown in FIG. 7 is provided.

Here, the estimating portions 253, 254 for performing the narrowing estimation correspond to a "third sound source position estimating portion" of the present invention respectively.

Third Embodiment

Figure 8:
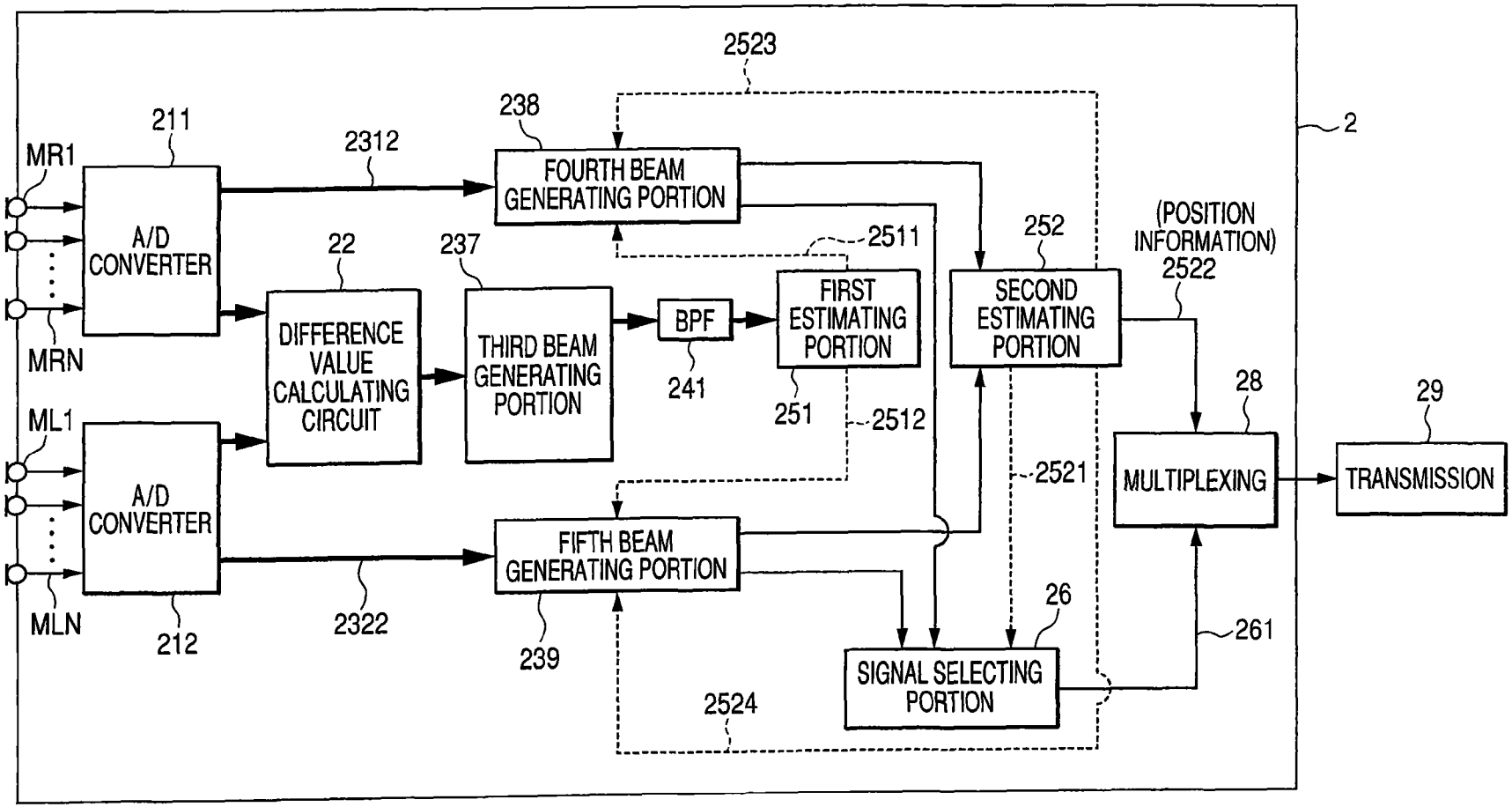
[FIG. 8] A block diagram of a transmitting portion of a remote conference apparatus according to a third embodiment of the present invention.

Next, a transmitting portion of a remote conference apparatus according to a third embodiment of the present invention will be explained with reference to FIG. 8 hereunder. FIG. 8 is a block diagram of this transmitting portion. The transmitting potion 2 of the equipment of the present embodiment is different in that the outputs of the A/D converters 211, 212 are the inputs of the difference value calculating circuit 22, a third beam generating portion 237 for generating the sound collecting beam by using the output signal of the difference value calculating circuit 22 is provided, a fourth beam generating portion 238 and a fifth beam generating portion 239 are provided, and the selectors 271, 272 are neglected. The same reference symbols are affixed to remaining portions, and above explanation will be applied correspondingly to remaining portions. Then, different points and important points of the equipment of the present embodiment will be explained hereunder.

As shown in FIG. 8, the outputs of the A/D converters 211, 212 are input directly into the difference value calculating circuit 22. Hence, in the equipment of the second embodiment, equal numbers of the microphone array MRi and the microphone array MLi are provided mutually in symmetrical positions. The difference value calculating circuit 22 calculates "(the sound signal of the microphone array MRi)—(the sound signal of the microphone array MLi)" (i=1 to N) respectively. Accordingly, like the equipment shown in FIG. 4, the sounds that detour around the microphone arrays MR, ML from the speaker array SPA and are input into the microphone arrays MR, ML can be canceled.

Here, in the equipment of the third embodiment, respective microphone arrays MR, ML must be provided bilaterally symmetrically with respect to a centerline of the speaker array SPA in the longitudinal direction. The difference value calculating circuit 22 is provided to cancel the detouring sound between the microphones. In this case, the difference value calculating circuit 22 always executes the calculation during the operation of the microphone arrays MR, ML of the remote conference apparatus 1.

Like the first beam generating portion 231 and the second beam generating portion 232, the third beam generating portion 237 outputs the sound collecting beams that have four virtual sound collecting areas as the focal points, based on a bundle of output signals of the difference value calculating circuit 22. The virtual sound collecting areas correspond to the sound collecting area pairs (411R and 411L, 412R and 412L, 413R and 413L, 414R and 414L: see FIG. 3) being set bilaterally symmetrically with respect to a centerline 101 of the speaker array SPA. The sound signal output from the third beam generating portion 237 is similar to the difference signals D(411), D(412), D(413), D(414) in the first embodiment. When this difference signal is output to the first estimating portion 251 through a BPF 241, estimation of the sound source position can be executed similarly to the first estimating portion 251 of the equipment shown in FIG. 4. Estimated results 2511, 2512 are output to the fourth beam generating portion 238 and the fifth beam generating portion 239.

Then, the fourth beam generating portion 238 and the fifth beam generating portion 239 in FIG. 8 will be explained hereunder. The digital sound signals that are output by the A/D converters 211, 212 are input directly to the fourth beam generating portion 238 and the fifth beam generating portion 239 respectively. The fourth beam generating portion 238 and the fifth beam generating portion 239 generate the sound collecting beams having the sound collecting areas, which are instructed by the estimated results 2511, 2512 input from the first estimating portion 251, as the focal point based on these digital sound signals, and pick up the sound signals of that sound collecting areas. In other words, the sound collecting beams that the fourth beam generating portion 238 and the fifth beam generating portion 239 generate correspond to the sound collecting beams that the selectors 271, 272 select in the first embodiment.

In this manner, the fourth beam generating portion 238 and the fifth beam generating portion 239 output only one-system sound signal picked up by the sound collecting beam instructed by the first estimating portion 251. The sound signals that the fourth beam generating portion 238 and the fifth beam generating portion 239 picked up from the sound collecting areas as the focal points of respective sound collecting beams are input into the second estimating portion 252.

Following operations are similar to those in the first embodiment. The second estimating portion 252 compares two sound signals, and then decides that the sound source resides in the sound collecting area whose sound volume level is higher. The second estimating portion 252 outputs information indicating the direction and the distance of the sound collecting area, in which the true sound source exists, to the multiplexing portion 28 as the position information 2522. Also, the second estimating portion 252 instructs the signal selecting portion 26 to input selectively the sound signal of this true sound source into the multiplexing portion 28. The multiplexing portion 28 multiplexes position information 2522 with a sound signal 261 of the true sound source selected by the signal selecting portion 26, and transmits this multiplexed signal to the opposing equipment.

Here, in the third embodiment shown in FIG. 8, like the second embodiment, if the estimation is executed in multiple stages, the position of the sound source can be searched widely for the first time and then such position can be searched again so as to restrict the range narrowly. In such case, the second estimating portion 252 outputs instruction inputs 2523, 2524, which instruct to search the narrower range, to the fourth and fifth beam generating portions 238, 239 after the first searching is completed. This operation is applied only to the beam generating portion on the side where the sound source is located. The beam generating portion, when received this instruction input, reads the delay pattern corresponding to a narrower range from the inside, and rewrites the delay pattern data 40*j* in the ROM.

In the first and third embodiments, the first estimating portion 251 selects the sound collecting areas (41*j*R, 41*j*L) one by one from the left and right sound collecting areas 411R to 414R, 411L to 414L respectively, and then the second estimating portion 252 estimates in which one of the sound collecting areas 41*j*R, 41*j*L the true sound source resides. But there is no need that the second estimating portion should always be provided.

This is because, for example, no trouble is caused even if the synthesized signal (or difference signal) of the sounds in both the sound collecting areas 41*j*R, 41*j*L is output as it is to the opposing equipment as the sound collecting signal in the case that no noise sound source is present on the opposite side of the true sound source, e.g., the remote conference apparatus is used only on the right side or the left side, or the like.

Also, the numerical values, and the like given in these embodiments should not be interpreted to limit the present invention. Also, when the signals are exchanged between the configurative blocks to fulfill the functions in above Figures, there are some cases where the similar advantages to those in the foregoing embodiments can be achieved by the configuration that a part of functions of these blocks is processed by other blocks.

Fourth Embodiment

Figure 9A:
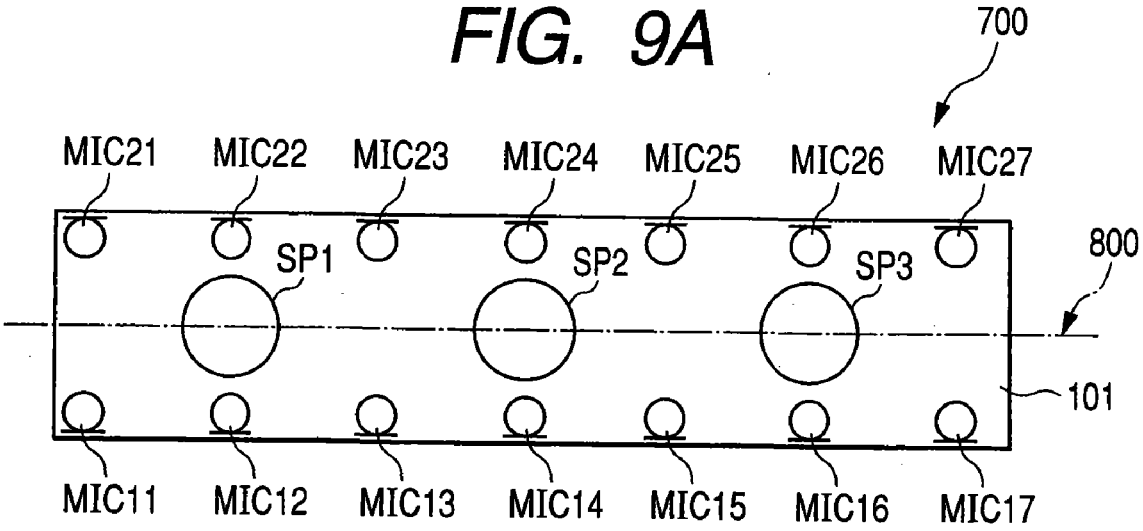
[FIG. 9A] A plan view showing a microphone/speaker arrangement of a sound emitting/collecting apparatus according to the present embodiment.
Figure 9B:
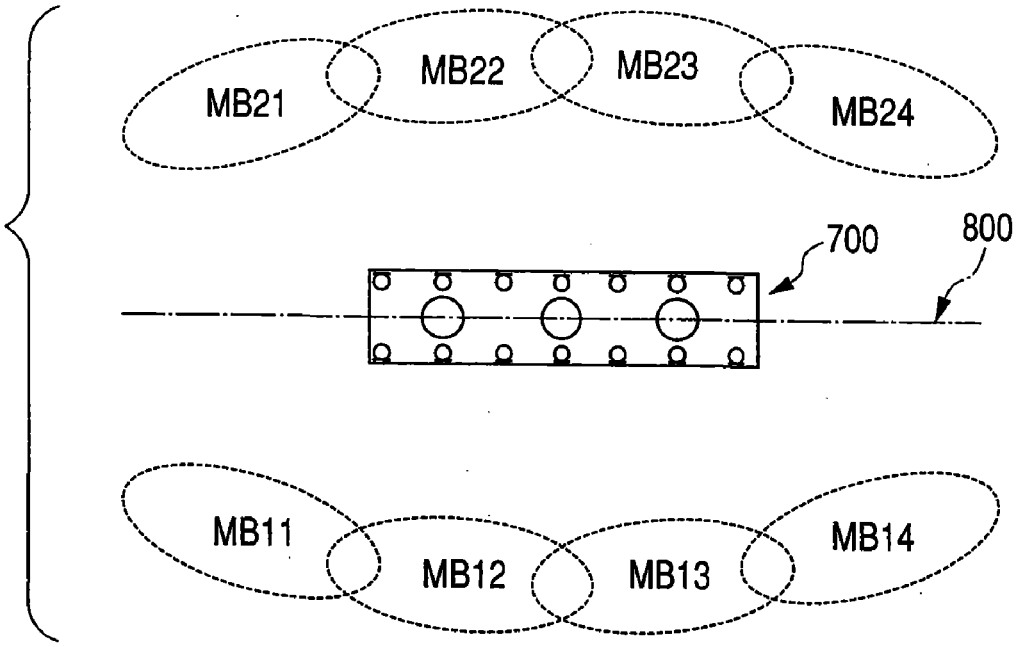
[FIG. 9B] A view showing sound collecting beam areas created by the sound emitting/collecting apparatus.

FIG. 9A is a plan view showing a microphone/speaker arrangement of a sound emitting/collecting apparatus 700 according to a fourth embodiment of the present embodiment, and FIG. 9B is a view showing sound collecting beam areas created by the sound emitting/collecting apparatus 700 shown in FIG. 9A.

Figure 10:
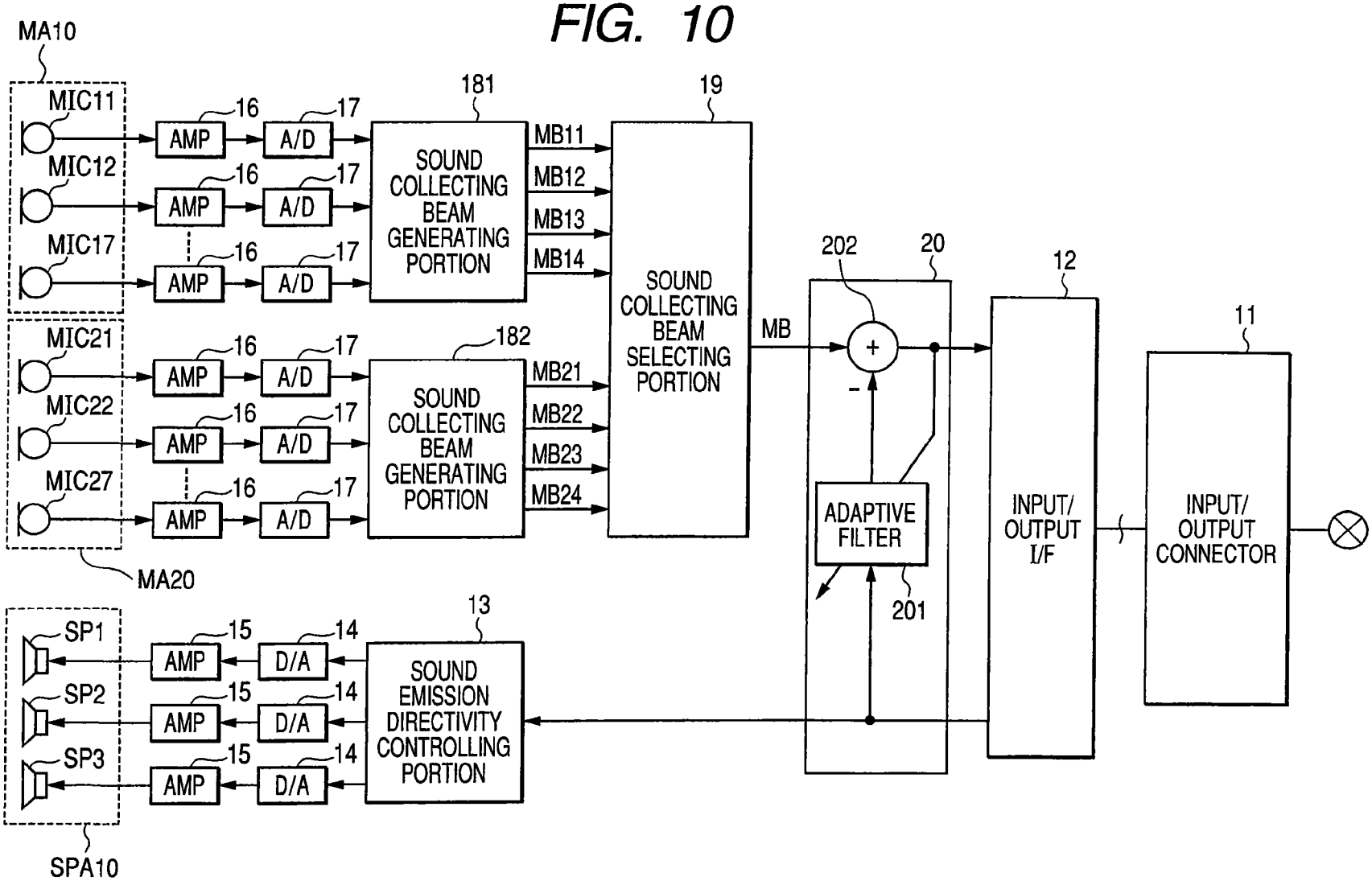
[FIG. 10] A functional block diagram of the sound emitting/collecting apparatus of the present embodiment.
Figure 11:
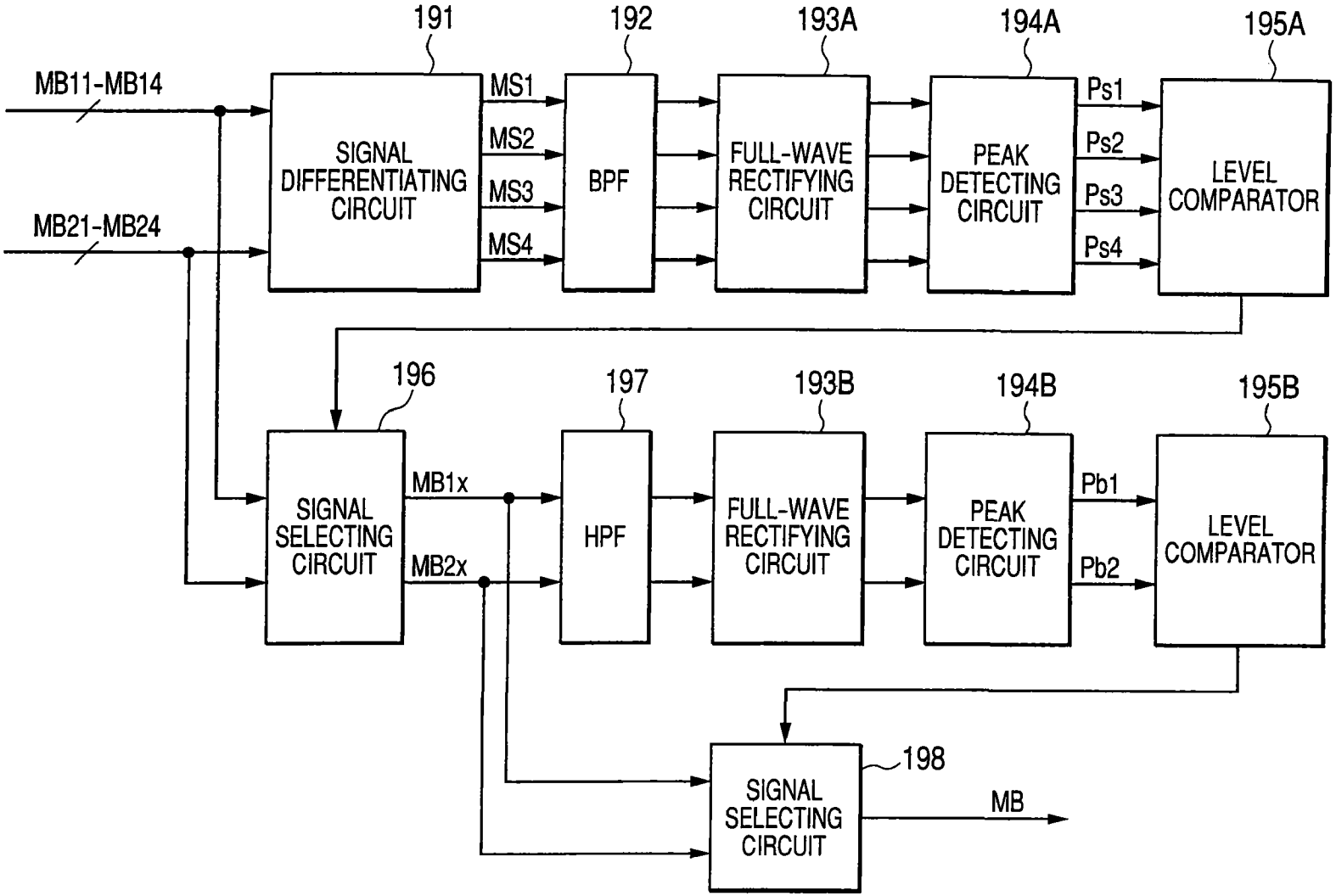
[FIG. 11] A block diagram showing a configuration of a sound collecting beam selecting portion 19 shown in FIG. 10.

FIG. 10 is a functional block diagram of the sound emitting/collecting apparatus 700 of the present embodiment. Also, FIG. 11 is a block diagram showing a configuration of a sound collecting beam selecting portion 19 shown in FIG. 10.

The sound emitting/collecting apparatus 700 of the present embodiment contains a plurality of speakers SP1 to SP3, a plurality of microphones MIC11 to MC17, MIC21 to MIC27, and functional portions shown in FIG. 10 in a case 101.

The case 101 is an almost rectangular parallelepiped shape that is long and narrow in one direction. Leg portions (not shown) are provided on both end portions of long sides (surfaces) of the case 101. These leg portions lift up a lower surface of the case 101 at a predetermined distance from the installing floor surface and have a predetermined height respectively. In the following explanation, a longish surface of four side surfaces of the case 101 is called a long surface and a shortish surface is called a short surface.

Non-directional separate speakers SP1 to SP3 each having the same shape are provided to the lower surface of the case 101. These separate speakers SP1 to SP3 are provided along the longitudinal direction at a predetermined interval. Also, the separate speakers SP1 to SP3 are provided such that a straight line connecting the centers of the separate speakers SP1 to SP3 is set along the long surface of the case 101 and their positions in the horizontal direction coincide with a centerline 800 connecting the centers of the short surfaces. That is, the straight line connecting the centers of the separate speakers SP1 to SP3 is set on the vertical reference surface containing the centerline 800. A speaker array SPA10 is constructed by aligning/arranging the separate speakers SP1 to SP3 in this manner. In this state, when the sound that was not subjected to the relative delay control is emitted from the separate speakers SP1 to SP3 of the speaker array SPA10, the emitted sounds propagate equally to two long surfaces. At this time, the emitted sounds that propagate to two opposing long surfaces travel in the mutually symmetric directions that intersect orthogonally with the reference surface.

The microphones MIC11 to MIC17 having the same specification are provided on one long surface of the case 101. These microphones MIC11 to MIC17 are provided linearly at a predetermined interval along the long direction, and thus the microphone array MA10 is constructed. Also, the microphone MIC21 to MIC27 having the same specification are provided on the other long surface of the case 101. These microphones MIC21 to MIC27 are provided linearly at a predetermined interval along the long direction, and thus the microphone array MA20 is constructed. The microphone array MA10 and the microphone array MA20 are arranged such that vertical positions of their alignment axes coincide with each other. Also, the microphones MIC11 to MIC17 of the microphone array MA10 and the microphones MIC21 to MIC27 of the microphone array MA20 are arranged in symmetrical positions with respect to the reference surface respectively. Concretely, for example, the microphone MIC11 and the microphone MIC21 are positioned symmetrically with respect to the reference surface, and similarly the microphone MIC17 and the microphone MIC27 have a symmetrical relationship.

In the present embodiment, the number of speakers of the speaker array SPA10 is set to three and the number of microphones of the microphone arrays MA10, MA20 is set to seven respectively. But these numbers are not restricted to them, and the number of speakers and the number of microphones may be set appropriately according to the specification. Also, each speaker interval of the speaker array and each microphone interval of the microphone array may be set unevenly. For example, the speakers and the microphones may be arranged densely in the center portion along the long direction, and arranged coarsely gradually toward both end portions.

Then, as shown in FIG. 10, the sound emitting/collecting apparatus 700 of the present embodiment contains functionally an input/output connector 11, an input/output I/F 12, a sound emission directivity controlling portion 13, D/A converters 14, sound emitting amplifiers 15, the speaker array SPA10 (the speakers SP1 to SP3), the microphone arrays MA10, MA20 (the microphones MIC11 to MIC17, MIC21 to MIC27), sound collecting amplifiers 16, A/D converters 17, sound collecting beam generating portions 181, 182, a sound collecting beam selecting portion 19, and an echo canceling portion 20.

The input/output I/F 12 converts the input sound signal input from other sound emitting/collecting apparatus via the input/output connector 11 from the data format (protocol) corresponding to the network, and gives the sound signal to the sound emission directivity controlling portion 13 via the echo canceling portion 20. Also, the input/output I/F 12 converts the output sound signal generated by the echo canceling portion 20 into the data format (protocol) corresponding to the network, and sends out the sound signal to the network via the input/output connector 11. At this time, the input/output I/F 12 transmits the sound signal, which is obtained by limiting a frequency band of the output sound signal, to the network. This is because the sound signal containing full frequency components has a huge amount of data and thus a transmission rate on the network is significantly lowered if the output sound signal is transmitted to the network as it is, and because the sound emitting/collecting apparatus on the opposing side can reproduce the talking sound sufficiently unless a predetermined high-frequency component (e.g., a frequency component of 3.5 kHz or more) is not propagated. Therefore, the input sound signal from the sound emitting/collecting apparatus on the opposing side is the sound signal in which a high-frequency component in excess of a predetermined threshold value is not contained.

The sound emission directivity controlling portion 13 applies the delay process, the amplitude process, etc. peculiar to the speakers SP1 to SP3 of the speaker array SPA respectively to the input sound signal based on the designated sound emission directivity, and generates individual sound emitting signals. The sound emission directivity controlling portion 13 outputs these individual sound emitting signals to the D/A converters 14 provided individually to the speakers SP1 to SP3. The D/A converters 14 convert the individual sound emitting signals into the analog format, and output the signals to the sound emitting amplifiers 15 respectively. The sound emitting amplifiers 15 amplify the individual sound emitting signals and supply the signals to the speakers SP1 to SP3.

The speakers SP1 to SP3 convert the given individual sound emitting signals into the sound and emit this sound to the outside. At this time, since the speakers SP1 to SP3 are provided on the lower surface of the case 101, the emitted sounds are reflected by the surface of the desk on which the sound emitting/collecting apparatus 700 is put, and are propagated obliquely upward from the side of the equipment at which the attendances sit.

As the microphones MIC11 to MIC17, MIC21 to MIC27 of the microphone arrays MA10, MA20, non-directional or directional ones may be employed but desirably directional ones should be employed. Respective microphones pick up the sounds from the outside of the sound emitting/collecting apparatus 700, then electrically convert the sounds into the sound collecting signals, and then output the sound collecting signals to the sound collecting amplifiers 16. The sound collecting amplifiers 16 amplify the sound collecting signals, and feed the amplified signals to the A/D converters 17. The AND converters 17 convert the sound collecting signals into the digital signals, and feed the digital signals to the sound collecting beam generating portions 181, 182. The sound collecting signals picked up by the microphones MIC11 to MIC17 of the microphone array MA10 provided on one long surface are input into the sound collecting beam generating portion 181, while the sound collecting signals picked up by the microphones MIC21 to MIC27 of the microphone array MA20 provided on the other long surface are input into the sound collecting beam generating portion 182.

The sound collecting beam generating portion 181 applies a predetermined delay process, etc. to the sound collecting signals from the microphones MIC11 to MIC17, and generates sound collecting beam signals MB11 to MB14. As shown in FIG. 9B, for the sound collecting beam signals MB11 to MB14, areas having predetermined different widths respectively are set as the sound collecting beam areas on the long surface side on which the microphones MIC11 to MIC17 are provided along the long surface.

The sound collecting beam generating portion 182 applies the predetermined delay process, etc. to the sound collecting signals from the microphones MIC21 to MIC27, and generates sound collecting beam signals MB21 to MB24. As shown in FIG. 9B, for the sound collecting beam signals MB21 to MB24, areas having predetermined different widths respectively are set as the sound collecting beam areas on the long surface side on which the microphones MIC21 to MIC27 are provided along the long surface.

At this time, the sound collecting beam signal MB11 and the sound collecting beam signal MB21 are formed as symmetrical beams with respect to the vertical surface (reference surface) having the center axis 800. Similarly, the sound collecting beam signal MB12 and the sound collecting beam signal MB22, the sound collecting beam signal MB13 and the sound collecting beam signal MB23, and the sound collecting beam signal MB14 and the sound collecting beam signal MB24 are formed as symmetrical beams with respect to the reference surface.

The sound collecting beam selecting portion 19 selects an optimum sound collecting beam signal MB from the input sound collecting beam signals MB11 to MB14, MB21 to MB24 and outputs the optimum sound collecting beam signal MB to the echo canceling portion 20.

FIG. 11 is a block diagram showing a main configuration of the sound collecting beam selecting portion 19.

The sound collecting beam selecting portion 19 has a signal differentiating circuit 191, a BPF (band-pass filter) 192, full-wave rectifying circuits 193A, 193B, peak detecting circuits 194A, 194B, level comparators 195A, 195B, signal selecting circuits 196, 198, and a HPF (high-pass filter) 197.

The signal differentiating circuit 191 calculates differences between the sound collecting beam signals, which are symmetrical with respect to the reference surface, out of the sound collecting beam signals MB11-MB14, MB21-MB24. Concretely, the signal differentiating circuit 191 calculates a difference between the sound collecting beam signals MB11 and MB21 to generate a difference signal MS1, and calculates a difference between the sound collecting beam signals MB12 and MB22 to generate a difference signal MS2. Also, the signal differentiating circuit 191 calculates a difference between the sound collecting beam signals MB13 and MB23 to generate a difference signal MS3, and calculates a difference between the sound collecting beam signals MB14 and MB24 to generate a difference signal MS4. In the difference signals MS1 to MS4 generated in this manner, because the sound collecting beam signals as the source are symmetrical with respect to an axis of the speaker array on the reference surface, the detouring sound components contained mutually in the sound collecting beam signals are canceled. Therefore, the signals in which the detouring sound components from the speakers are suppressed are produced.

The BPF 241 is a band pass filter that has a band that is dominant in the beam characteristic and a band of a main component of the human voice as a passing band. The BPF 241 applies a band-pass filtering process to the difference signals MS1 to MS4 and outputs the filtered signals to the full-wave rectifying circuit 193A. The full-wave rectifying circuit 193A rectifies the difference signals MS1 to MS4 over a full wave (calculates absolute values), and the peak detecting circuit 194A detects peaks of the difference signals MS1 to MS4 that were subjected to the full-wave rectification, and outputs peak value data Ps1 to Ps4. The level comparator 195A compares the peak value data Ps1 to Ps4, and gives selection instruction data used to select the difference signal MS corresponding to the peak value data Ps at the highest level to the signal selecting circuit 196. In this case, such an event is utilized that the signal level of the sound collecting beam signal corresponding to the sound collecting area in which the talker is present is higher than the signal levels of the sound collecting beam signals corresponding to other areas.

Figure 12A:
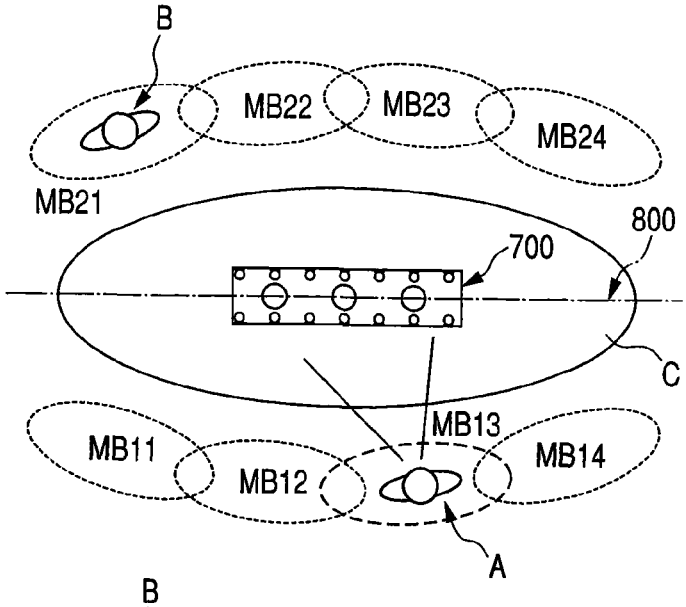
[FIG. 12A] A view showing a situation that two attendances A, B have a session while putting a sound emitting/collecting apparatus 1 of the present embodiment on a desk C and the attendance A is talking now.
Figure 12B:
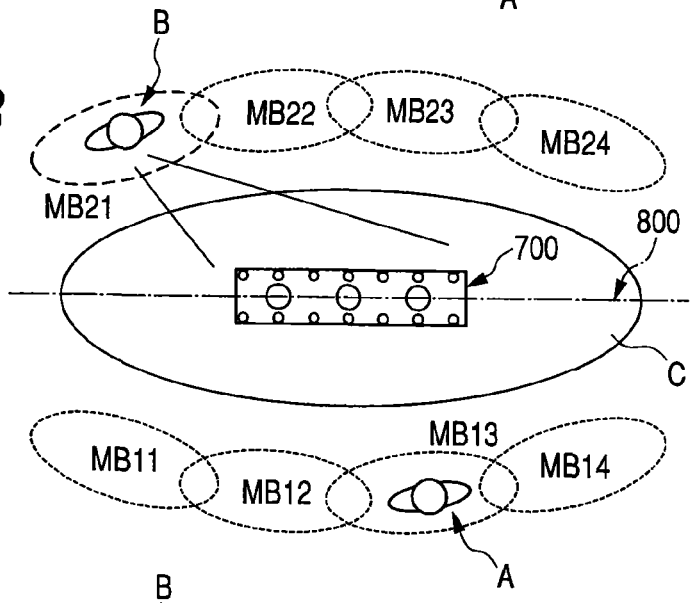
[FIG. 12B] A view showing a situation that the attendance B is talking now.
Figure 12C:
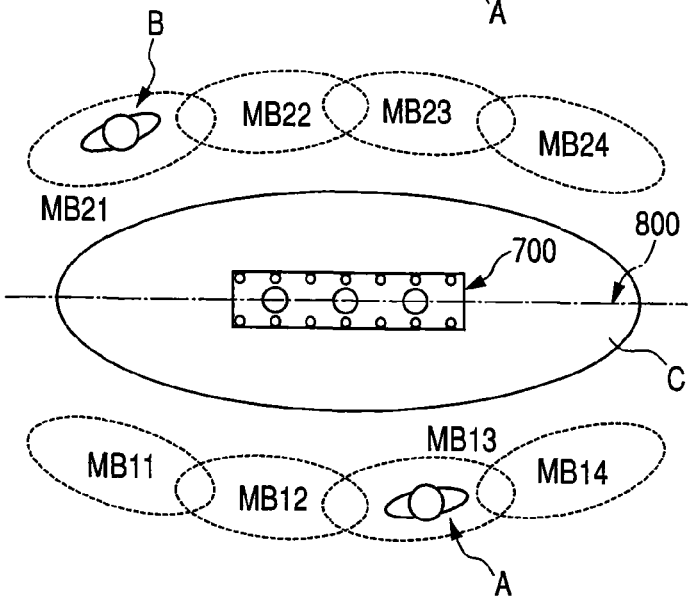
[FIG. 12C] A view showing a situation that none of the attendances A, B is talking.

FIGS. 12A to 12C are views showing a situation that two attendances A, B have a session while putting the sound emitting/collecting apparatus 700 of the present embodiment on a desk C. FIG. 12A shows a situation that the attendance A is talking now, FIG. 12B shows a situation that the attendance B is talking now, and FIG. 12C shows a situation that none of the attendances A, B is talking.

For example, as shown in FIG. 12A, when an attendance A in the area corresponding to the sound collecting beam signal MB13 starts to talk, the signal level of the sound collecting beam signal MB13 becomes higher than the signal levels of sound collecting beam signals MB11, MB12, MB14, MB21 to MB24. Therefore, the signal level of the difference signal MS3 obtained by subtracting the sound collecting beam signal MB13 from the sound collecting beam signal MB23 becomes higher than the signal levels of the difference signals MS1, MS2, MS4. As a result, peak value data Ps3 of the difference signal MS3 is higher than other peak value data Ps1, Ps2, Ps4, and then the level comparator 195A detects the peak value data Ps3 and gives selection instructing data used to select the difference signal MS3 to the signal selecting circuit 196. In contrast, as shown in FIG. 12B, when an attendance B in the area corresponding to the sound collecting beam signal MB21 starts to talk, the level comparator 195A detects the peak value data Ps1 and gives selection instructing data used to select the difference signal MS1 to the signal selecting circuit 196.

Here, as shown in FIG. 12C, in a situation that both the attendances A, B are not talking, the level comparator 195A gives the preceding selection instructing data to the signal selecting circuit 196 as soon as it detects that all peak value data Ps1 to Ps4 do not reach a predetermined threshold value.

The signal selecting circuit 196 selects two sound collecting beam signals MB1*x*, MB2*x* (x=1 to 4) constituting the difference signal MS instructed by the given selection instructing data. For example, the signal selecting circuit 196 selects the sound collecting beam signals MB13, MB23 constituting the difference signal MS3 in the situation in FIG. 12A, while the signal selecting circuit 196 selects the sound collecting beam signals MB11, MB21 constituting the difference signal MS1 in the situation in FIG. 12B.

The HPF 197 executes a filtering process to pass only a high-frequency component of the selected sound collecting beam signals MB1*x*, MB2*x*, and outputs the components to the full-wave rectifying circuit 193B. Because the high-frequency component passing process, i.e., the attenuating process on a component except the high-frequency component is applied, as described above, the input sound signal that does not contain the high-frequency component, i.e., components of the detouring sound can be removed. Accordingly, the high-pass processed signals in which only the sound from the talker on the own equipment side is contained are formed. The full-wave rectifying circuit 193B rectifies the high-pass processed signals corresponding to the sound collecting beam signals MB1*x*, MB2*x* over a full wave (calculates absolute values), and the peak detecting circuit 194B detects peaks of the high-pass processed signals and outputs peak value data Pb1, Pb2. The level comparator 195B compares the peak value data Pb1, Pb2, and gives selection instruction data used to select the sound collecting beam signal Mbax (a=1 or 2) corresponding to the peak value data Ps at the higher level to the signal selecting circuit 198. In this case, such an event is utilized that the signal level of the sound collecting beam signal corresponding to the sound collecting area in which the talker is present is higher than the signal levels of the sound collecting beam signals corresponding to the sound collecting areas that oppose to the reference surface.

For example, as shown in FIG. 12A, when the attendance A in the area corresponding to the sound collecting beam signal MB13 talks, the signal level of the sound collecting beam signal MB13 goes higher than the signal level of the sound collecting beam signal MB23. Therefore, the peak value data Pb1 of the sound collecting beam signal MB13 goes higher than the peak value data Pb2 of the sound collecting beam signal MB23, the level comparator 195B detects the peak value data Pb1 and gives selection instruction data used to select the sound collecting beam signal MB13 to the signal selecting circuit 198. In contrast, as shown in FIG. 12B, when the attendance B in the area corresponding to the sound collecting beam signal MB21 talks, the level comparator 195B detects the peak value data Pb2 and gives selection instruction data used to select the sound collecting beam signal MB21 to the signal selecting circuit 198. In this case, as shown in FIG. 12C, when no talker speaks and also the peak value data Pb1, Pb2 of two sound collecting beam signals MB1*x*, MB2*x* are below a predetermined threshold value, the level comparator 195B gives the preceding selection instruction data to the signal selecting circuit 198.

The signal selecting circuit 198 selects the sound collecting beam signal having the higher signal level from the sound collecting beam signals MB1*x*, MB2*x* selected by the signal selecting circuit 196 in accordance with the selection instruction data of the level comparator 195B, and outputs such signal to the echo canceling portion 20 as the sound collecting beam signal MB.

For example, as described above, in the situation in FIG. 12A, the signal selecting circuit 198 selects the sound collecting beam signal MB13 from the sound collecting beam signal MB13 and the sound collecting beam signal MB23 in accordance with the selection instruction data, and outputs such signal. In contrast, in the situation in FIG. 12B, the signal selecting circuit 198 selects the sound collecting beam signal MB21 from the sound collecting beam signal MB11 and the sound collecting beam signal MB21, and outputs such signal. Also, in the situation in FIG. 12A, the signal selecting circuit 198 outputs the sound collecting beam signal MB13 when the preceding sound collecting beam signal is the sound collecting beam signal MB13 in accordance with the selection instruction data, and outputs the sound collecting beam signal MB21 when the preceding sound collecting beam signal is the sound collecting beam signal MB21. According to the application of such process, the talker direction can be detected without influence of the detouring sound from the speaker to the microphone, and the sound collecting beam signal MB that can set a center of a directivity in that direction can be generated. That is, the voice from the talker can be picked up at a high S/N ratio.

The echo canceling portion 20 has an adaptive filter 201 and a post processor 202. The adaptive filter 201 generates an artificial detouring sound signal based on the sound collecting directivity of the selected sound collecting beam signal MB in response to the input sound signal. The post processor 202 subtracts the artificial detouring sound signal from the sound collecting beam signal MB output from the sound collecting beam selecting portion 19, and outputs a subtracted signal to the input/output I/F 12 as the output sound signal. Since such echo canceling process is executed, the echo removal can be executed adequately and only the voice of the talker belonging to the own equipment can be transmitted to the network as the output sound signal.

As described above, the talker direction can be detected without influence of the detouring sound by using the configuration of the present invention. As a result, the voice of the talker can be picked up at a high S/N ratio and then can be transmitted to the sound emitting/collecting apparatus on the opposing side.

The invention claimed is:

1. A remote conference apparatus, comprising:

a speaker array, including a plurality of speakers, which emit a sound upward or downward;

a first microphone array and a second microphone array which are provided to pick up the sounds from both sides of the speaker array in a longitudinal direction of the speaker array;

a first beam generating portion operatively arranged to generate a plurality of first sound collecting beams, the first sound collecting beams operatively arranged to place focal points on a plurality of first sound collecting areas decided previously in the first microphone array side respectively, by applying delay processes to sound signals that microphones of the first microphone array pick up respectively with a predetermined amount of delay respectively and synthesizing the delayed sound signals;

a second beam generating portion operatively arranged to generate a plurality of second sound collecting beams, the second sound collecting beams operatively arranged to place focal points on a plurality of second sound collecting areas decided previously in the second microphone array side respectively, by applying delay processes to sound signals that microphones of the second microphone array pick up respectively with a predetermined amount of delay respectively and synthesizing the delayed sound signals;

a difference signal calculating portion operatively arranged to calculate difference signals of the sound collecting beams, that correspond to pairs of sound collecting areas in mutually symmetrical positions with respect to a centerline of the speaker array in the longitudinal direction, out of the sound collecting beams that are generated toward the plurality of first sound collecting areas and the plurality of second sound collecting areas, respectively;

a first sound source position estimating portion operatively arranged to select a pair of sound collecting areas in which a signal strength of the difference signal is large; and a second sound source position estimating portion operatively arranged to select a sound collecting area corresponding to the sound collecting beam whose strength is larger from the pair of sound collecting areas selected by the first sound source position estimating portion and operatively arranged to estimate that a sound source position is present in the selected sound collecting area.

2. The remote conference apparatus according to claim 1, wherein the first beam generating portion and the second beam generating portion set further a plurality of narrow sound collecting areas in the sound collecting area which is selected by the second sound source position estimating portion to generate a plurality of narrow sound collecting beams that place a focal point on the narrow sound collecting areas respectively, and the remote conference apparatus further comprising: a third sound source position estimating portion operatively arranged to estimate that a sound source position is present in an area of the sound collecting beam in which a strength of the sound signal is large, out of the sound collecting beams corresponding to the plurality of narrow sound collecting areas.

3. A remote conference apparatus, comprising:

a speaker array, including a plurality of speakers, operatively arranged to emit a sound upward or downward;

a first microphone array and a second microphone array operatively arranged to align a plurality of microphones mutually symmetrically on both sides of a centerline of the speaker array in a longitudinal direction of the speaker array;

a difference signal calculating portion operatively arranged to calculate difference signals by subtracting sound signals picked up by respective microphones of the first and second microphone arrays every pair of microphones positioned mutually in symmetrical positions;

a first beam generating portion operatively arranged to generate a plurality of first sound collecting beams that place focal points on a plurality of pairs of predetermined sound collecting areas in mutual symmetrical positions respectively, by synthesizing the difference signals mutually while adjusting an amount of delay;

a first sound source position estimating portion operatively arranged to select a pair of sound collecting areas in which a signal strength of the difference signal is large, out of the plurality of pairs of sound collecting areas;

a second beam generating portion operatively arranged to generate a sound collecting beam to pick up the sound signal from each sound collecting area in the pair of sound collecting areas that is selected by the first sound source position estimating portion, based on the sound signal picked up by each microphone of the first microphone array;

a third beam generating portion operatively arranged to generate a sound collecting beam to pick up the sound signal from each sound collecting area in the pair of sound collecting areas selected by the first sound source position estimating portion, based on the sound signal picked up by each microphone of the second microphone array; and a second sound source position estimating portion operatively arranged to select a sound collecting area corresponding to a sound signal whose signal strength is larger out of the sound signals picked up by the sound collecting beams that the second and third beam generating portions generate and operatively arranged to estimate that a sound source position is present in the selected sound collecting area.

4. A sound emitting/collecting apparatus, comprising:

a speaker which emits sounds in directions that are symmetrical with respect to a predetermined reference surface respectively;

a first microphone array which picks up the sound on one side of the predetermined reference surface;

a second microphone array which picks up the sound on other side of the predetermined reference surface;

a sound collecting beam signal generating portion operatively arranged to generate first sound collecting beam signals to pick up the sounds from a plurality of first sound collecting areas based on a sound collecting signal of the first microphone array, and operatively arranged to generate second sound collecting beam signals to pick up the sounds from a plurality of second sound collecting areas provided in symmetrical positions to the first sound collecting areas with respect to the predetermined reference surface based on a sound collecting signal of the second microphone array; and a sound collecting beam signal selecting portion operatively arranged to subtract the sound collecting beam signals to each other that are symmetrical mutually with respect to the predetermined reference surface, operatively arranged to extract only high-frequency components from two sound collecting beam signals constituting a difference signal whose signal level is highest, and operatively arranged to select one sound collecting beam signal having high-frequency component whose signal level is higher out of the two sound collection beam signals based on a result of the extracted high-frequency components.

5. The sound emitting/collecting apparatus according to claim 4, wherein the sound collecting beam signal selecting portion includes: a difference signal detecting portion operatively arranged to subtract the sound collecting beam signals to each other that are symmetrical mutually to detect a difference signal whose signal level is highest; a high-frequency component signal extracting portion which has high-pass filters that pass only high-frequency components of two sound collecting beam signals from which the difference signal is detected by the difference signal detecting portion respectively, and detects the high-frequency component signal whose signal level is higher from the high-frequency component signals that passed through the high-pass filters; and a selecting portion operatively arranged to select the sound collecting beam signal corresponding to the high-frequency component signal detected by the high-frequency component signal extracting portion, and operatively arranged to output the selected sound collecting beam signal.

6. The sound emitting/collecting apparatus according to claim 4, wherein the speaker is constructed by a plurality of separate speakers aligned linearly along the predetermined reference surface.

7. The sound emitting/collecting apparatus according to claim 5, wherein the speaker is constructed by a plurality of separate speakers aligned linearly along the predetermined reference surface.

8. The sound emitting/collecting apparatus according to claim 4 further comprising a detouring sound removing portion operatively arranged to execute control such that the sound emitted from the speaker is not contained in the output sound signal, based on the input sound signal and the sound collecting beam signal selected by the sound collecting beam signal selecting portion.

9. The sound emitting/collecting apparatus according to claim 5 further comprising a detouring sound removing portion operatively arranged to execute control such that the sound emitted from the speaker is not contained in the output sound signal, based on the input sound signal and the sound collecting beam signal selected by the sound collecting beam signal selecting portion.

* * * * *